US006141983A

United States Patent [19]

Nishikawa et al.

[11] Patent Number: 6,141,983

[45] Date of Patent: Nov. 7, 2000

[54] AIR CONDITIONER

[75] Inventors: Kazuhiro Nishikawa, Osaka; Hirozumi Ito, Shiga; Noriya Asada, Kyoto; Chiaki Morimoto, Kyoto; Hirokazu Sakai, Kyoto; Shigeki Tomita, Shiga, all of Japan

[73] Assignee: Matsushita Electric Industrial Co., Ltd., Osaka, Japan

[21] Appl. No.: 09/302,736

[22] Filed: Apr. 30, 1999

[30] Foreign Application Priority Data

Jun. 30, 1998 [JP] Japan ..... 10-183771
Jun. 30, 1998 [JP] Japan ..... 10-183772

[51] Int. Cl.[7] ..... F24F 3/00

[52] U.S. Cl. ..... 62/259.1; 62/426; 165/53; 415/53.1; 415/53.3; 454/233

[58] Field of Search ..... 454/233; 415/53.1, 415/53.3; 62/244, 259.1, 426, 419; 165/122, 53

[56] References Cited

U.S. PATENT DOCUMENTS 4,854,375 8/1989 Frina et al. ..... 165/53
4,958,504 9/1990 Ichikawa et al. ..... 62/244
5,127,238 7/1992 Ichikawa et al. ..... 62/244
5,197,850 3/1993 Shinobu et al. ..... 415/53.1

FOREIGN PATENT DOCUMENTS 09166353 6/1997 Japan .

*Primary Examiner*—Harold Joyce
*Attorney, Agent, or Firm*—Ratner & Prestia

[57] ABSTRACT

The constitution comprises a grille for sucking air, a heat exchanger for exchanging heat with the air, a blower for feeding the air exchanged of heat by the heat exchanger, and an air diffuser for blowing out the wind generated by the blower. The air diffuser has such a shape that the direction of the wind blown out from both ends in a horizontal direction may be the lower direction than the direction of the wind blown out from the center in the horizontal direction. The air diffuser has such a shape that the outer circumference of the section in the horizontal direction has a nearly arc shape. It can be installed at a corner of mutually adjacent walls of a room or on a wall. In this constitution, the heat exchanged wind reaches uniformly all parts of the room, and the comfort is notably enhanced. At the same time, generation of unusual sound is suppressed.

40 Claims, 35 Drawing Sheets

AIR CONDITIONER

FIELD OF THE INVENTION

The present invention relates to an air conditioner for cooling or heating the indoor air.

BACKGROUND OF THE INVENTION

A conventional air conditioner is composed as shown in FIG. 32 to FIG. 36 as disclosed, for example, in Japanese Laid-open Patent No. 9-166353. FIG. 32 is a perspective view of installation of an air conditioner in a room, and FIG. 33 is a plan view seen from the lower direction of FIG. 32. FIG. 34 is a sectional view along line 301–301 in FIG. 33, and FIG. 35 is an essential sectional view as seen from the lower direction of FIG. 34. FIG. 36 is a plane temperature distribution profile in air heating operation when the air conditioner main body is installed at a corner of a room.

An air conditioner main body 1 is installed closely to a corner of a ceiling 302 of a room and walls 303, 304 in two directions, and has a sector shape of a quarter arc, having a suction port at the lower side, and an air diffuser 2 in the arc part. While a cross flow fan 3 is rotated by a drive unit 4, air is sucked in from a front grille 5 having a suction port in the lower part, and heat is exchanged through a heat exchanger 7 provided above a water pan 6, and air flows into the arc-shaped air diffuser 2 composed of a stabilizer 8 and a rear guider 9. Thus, air blow action is achieved. Inside the air conditioner main body 1, an internal connection piping 11 is installed, and a wind direction changer 12 is attached to the air diffuser 2. Since the air diffuser 2 is arc-shaped, the distance is different at both ends of the cross flow fan 3 and air diffuser 2.

Such conventional air conditioner, however, has the following problems.

Since the air diffuser 2 is shaped to have a quarter arc, at both ends of the air diffuser 2, the length of the stabilizer 8 and rear guider 9 for composing the air diffuser 2 is extremely short, and the distance between the cross flow fan 3 and air diffuser 2 is close, and noise is likely to occur.

In FIG. 34, moreover, in the case the stabilizer 8 and rear guider 9 are inclined downward, as approaching from the center of the arc shape toward the both ends, the air diffuser 2 is scraped off upward. Accordingly, the appearance is impaired, and the comfort of air heating is worsened.

Besides, the water pan 6 is located at a position of clogging the suction port 5 near the cross flow fan 3, and the water pan 6 works as resistance to air blow, and therefore at high load, an unusual buzzing sound is likely to occur due to rotation of the cross flow fan 3.

Moreover, the air conditioner main body 1 is installed closely at the corner of the room ceiling 302 and walls 303, 304, the suction port is installed at the lower side, and the air diffuser 2 is installed at the front side. Accordingly, the suction region is limited, and the wall Coanda effect (the effect of the wind flowing along the wall) takes place. As a result, the blown air is pulled in the lower direction, and the wind is not directed in the horizontal direction when cooling the air. Furthermore, due to short circuit, the air conditioning capability is lowered. It is more likely to condense dew. When heating, the hot air reaches only near the air conditioner main body, and the temperature distribution in the room is not uniform, and the comfort is spoiled. When the air conditioner main body 1 is placed at a corner of a room, the temperature distribution in heating operation is shown in FIG. 36.

The invention is therefore intended to improve the noise performance, comfort and appearance, and further enhance the comfort by decreasing the temperature difference in the room, and prevent occurrence of unusual sound.

SUMMARY OF THE INVENTION

The air conditioner of the invention comprises:

a grille for sucking air, a heat exchanger for exchanging heat with the air, a blower for feeding the air exchanged of heat by the heat exchanger, and an air diffuser for blowing out the wind generated by the blower, in which the air diffuser has such a shape that the direction of the wind blown out from both ends in a horizontal direction may be the lower direction than the direction of the wind blown out from the center in the horizontal direction.

Preferably, the air diffuser has such a shape that the outer circumference of the section in the horizontal direction has a nearly arc shape.

Preferably, the section in the horizontal direction has a nearly sector shape.

Preferably, the air conditioner can be installed at a corner of the ceiling of a room and mutually adjacent walls.

Preferably, the air diffuser has a passage composed a stabilizer and a rear guider, and the wind is controlled in the blow-out condition by the shape of the stabilizer and rear guider in the passage, and is blown out from the air diffuser.

Preferably, the stabilizer and rear guider have a horizontal plane near the outlet of the air diffuser, and the region of the horizontal plane retreats to the back side of the air diffuser as going from the center of the air diffuser toward both ends.

Preferably, the stabilizer and rear guider have a horizontal plane near the outlet of the air diffuser, and the length of the horizontal plane becomes shorter as going from the center of the air diffuser toward both ends.

Preferably, the air diffuser has such a shape that the inclination is changed downward as going from the center in the horizontal direction toward both ends.

Preferably, the air diffuser has a wind direction changer placed at the opening of the air diffuser so as to be movable vertically.

Preferably, the stabilizer is placed at the lower side of the passage, and the stabilizer has a leading end bump formed at the leading end at the outlet of the air diffuser, at the center in the horizontal direction of the air diffuser.

Preferably, the stabilizer is placed at the lower side of the passage, and the stabilizer has a straightening plate extended nearly in the horizontal direction, placed at the leading end of the outlet of the air diffuser.

REFERENCE NUMERALS

Figure 1:
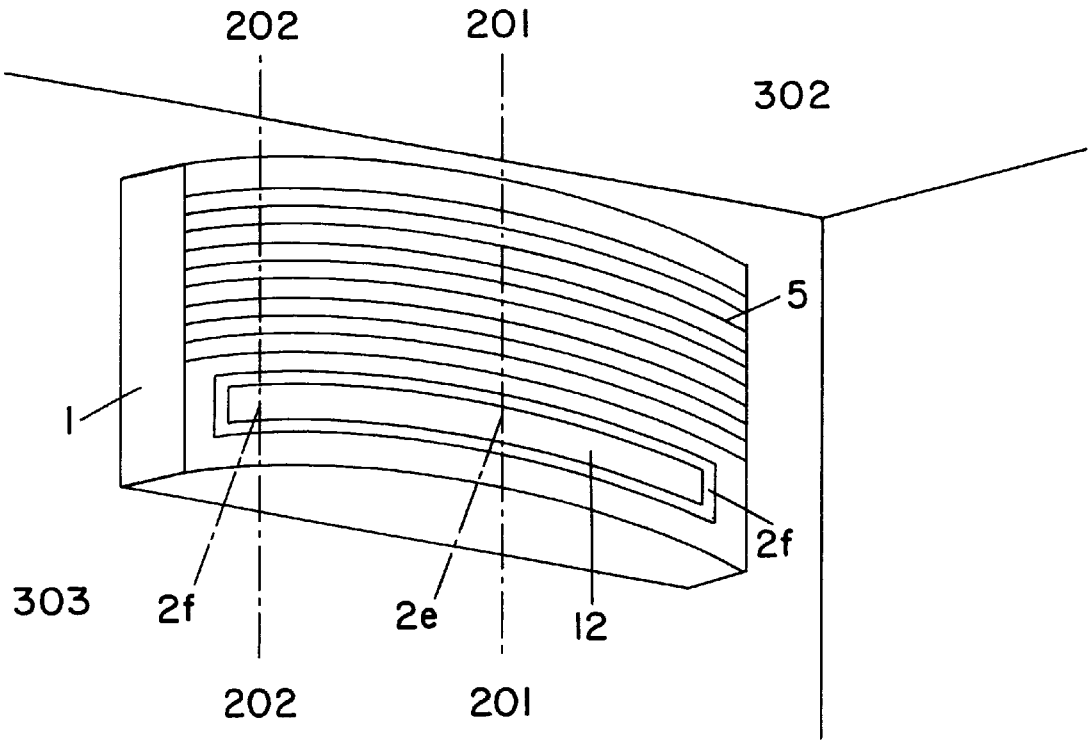
FIG. 1 is a perspective view of an air conditioner showing an embodiment of the invention.

1 Air conditioner main body
2 Air diffuser
**2*a*** Horizontal air diffuser
**2*b*** Leading end bump at lower side of horizontal air diffuser
**2*c*** Lower air diffuser
**2*d*** Straightening plate
**2*e*** Center
**2*f*** Both ends
**2*g*** Passage
2H Horizontal lane
3 Cross flow fan
4 Drive unit
5 Grille
**5*a*** Lower suction port
6 Water pan
7 Heat exchanger
8 Stabilizer
9 Rear guider
10 Trough
11 Internal connection piping
12 Wind direction changer
13 First bump shortest in distance to cross flow fan
14 Second bump provided at upstream side of first bump 13
15 Electrical part
16 Filter
17 Louver
18 Universal joint

DETAILED DESCRIPTION OF THE INVENTION

An air conditioner of the invention is an indoor side blower unit having a heat exchanger and a cross flow fan provided in a housing, with the horizontal section of an air diffuser in a nearly arc shape, in which an air passage is formed of a stabilizer and a rear guider positioned adjacently and oppositely to the cross flow fan, and the air diffuser is provided in this passage so as to be directly nearly in the horizontal direction at the center in the longitudinal direction and inclined downward from the center at both ends. According to this constitution, the air flowing along near the wall is directed downward, while the air flowing toward the center of the room is directed in the horizontal direction, so that an air flowing field of smooth reaching is formed. Besides, an adequate distance is held between the cross flow fan and the air diffuser, so that generation of noise is prevented. Moreover, since the height of the air diffuser is kept constant, the appearance is preferable.

Other air conditioner of the invention is an indoor side blower unit having a heat exchanger and a cross flow fan provided in a housing, with the horizontal section in a nearly sector shape, in which an air passage is formed of a stabilizer and a rear guider positioned adjacently and oppositely to the cross flow fan, and an air diffuser is provided in this passage so as to be directly nearly in the horizontal direction at the center in the longitudinal direction and inclined downward from the center at both ends. According to this constitution, when installed at a corner of a room, the air flowing along near the wall is directed downward, while the air flowing toward the center of the room is directed in the horizontal direction, so that an air flow is likely to reach the entire room. Therefore, the comfort is improved. Besides, generation of noise is prevented. Moreover, since the height of the air diffuser is kept constant, the appearance is preferable.

Preferably, in a blower circuit having a water pan for handling the condensate of the heat exchanger provided at the downstream of the suction port, the rear guider has a first bump disposed at a position where the distance between the cross flow fan and the rear guider is the shortest, and a second bump disposed at the upstream side of the air flow of the first bump. In this constitution, if the air suction balance is broken by the water pan, the air suction amount flowing in the cross flow fan can be adjusted, and unusual buzzing sound generated at high load can be canceled.

Preferably, the rear guider has a first bump disposed at a position where the distance between the cross flow fan and the rear guider is the shortest, and a second bump disposed at the upstream side of the air flow of the first bump, and the end portion of the second bump is larger than the central portion in the longitudinal direction. In this constitution, the complicated flow of the end portion is improved, and generation of unusual buzzing sound from the end portion can be canceled.

Preferably, at the downstream side of the suction part, an electrical part is disposed in the blower circuit at the upstream side of the heat exchanger. In this constitution, the space can be effectively utilized. Moreover, the electrical part is cooled. Further, a conventional electrical part can be used as a common part, and the cost is saved.

Preferably, at the downstream side of the suction port, a filter is disposed at the upstream side of the water pan. In this constitution, the dust in the room can be treated easily. Besides, an economical filter shape can be employed, and the material cost is reduced.

Preferably, at the downstream side of the suction port, a filter is disposed in a nearly L-shape so as to cover the heat exchanger. In this constitution, the dust in the room can be treated easily, and in the piping connection work, drain work or other mounting work, the filter does not disturb, and it is easy to work.

Preferably, an opening for sucking air is disposed in the ceiling of the housing. In this constitution, the air suction volume increases, and generation of unusual buzzing sound at high load can be canceled.

A different air conditioner of the invention is an indoor side blower unit having a heat exchanger and a cross flow fan provided in a housing, with the horizontal section of an air diffuser in a nearly arc shape, in which a plurality of cross flow fans are coupled through a universal joint, and disposed along the air diffuser. According to this constitution, the length of the cross flow fan and area of the heat exchanger are increased, and the air conditioning performance is enhanced, and the air conditioner main body is formed in a more compact body. Moreover, since the air is blown out at a side angle from the air diffuser, the room temperature becomes uniform quickly, and the comfort is improved.

A further different air conditioner of the invention is an indoor side blower unit having a heat exchanger and a cross flow fan provided in a housing, with the horizontal section of an air diffuser in a nearly arc shape, in which a wind direction changer is disposed at an outer side to cover the air diffuser, and is moved up and down in the vertical direction to blow the air flow in upper and lower direction. According to this constitution, the wind direction changer covers the air diffuser at a specified position, and the opening of the air diffuser is hardly visible from the user in such configuration. As a result, the appearance is improved. Moreover, since the wind direction changer is moved up and down at the outer side of the air diffuser, the vertical moving range is wider, and the wind direction changing range is wider.

Other different air conditioner of the invention can be installed closely to a corner of the ceiling in a room and two walls. This air conditioner is an indoor side blower unit having a suction port at the lower side, and an air diffuser, a heat exchanger and a cross flow fan provided at the front side, with the section of the air diffuser in a horizontal direction in a nearly sector shape. The air diffuser has an air passage formed of a stabilizer and a rear guider positioned adjacently and oppositely to the cross flow fan. In this passage, the central portion of the suction port in the horizontal direction has a horizontal air diffuser directed nearly in a horizontal direction. At the leading end part of the lower side of the horizontal air diffuser, a leading end bump of an arbitrary height is formed. Further, both ends of the air diffuser have a downward air diffuser inclined downward from the central portion, and a straightening plate extended nearly in a horizontal direction, disposed at the leading end portion of the lower side of the downward air diffuser.

In this constitution, the wind hitting against the leading end bump generates a velocity vector in the horizontal direction, and the air flowing toward the center of the room is more likely to be directed in the horizontal direction. In the constitution including the horizontal air diffuser, downward air diffuser, and straightening plate, the air flowing along near the wall is directed from the lower direction to the horizontal direction, and the short-circuit due to wall Coanda effect can be prevented, and it is smooth to reach the entire room. As a result, a further comfort is obtained.

Preferably, the air conditioner has a water pan for handling the condensate disposed between the suction port and heat exchanger.

Preferably, along with the horizontal air diffuser, the constitution further includes a downward air diffuser inclined downward from the center at both ends of the air diffuser, and a straightening plate extended nearly in a horizontal direction at the lower side leading end portion of the downward air diffuser. In this constitution, the air flowing along near the wall is directed from the lower direction to the horizontal direction. Hence, it is smooth to reach the entire room. As a result, the comfort is improved. Besides, the distance between the cross flow fan and air diffuser is longer, and hence the noise is lowered.

Preferably, a bump of an arbitrary height disposed at the lower side leading end portion of the horizontal air diffuser is formed of a water absorbing material such as non-woven cloth having water absorbing property. In this constitution, the dew condensation water depositing around the air diffuser at high load is absorbed by this water absorbing material, and drop of dew condensation water into the room is prevented.

Referring now to the drawings, preferred exemplary embodiments of the invention are described in detail below.

Exemplary Embodiment 1

Figure 2:
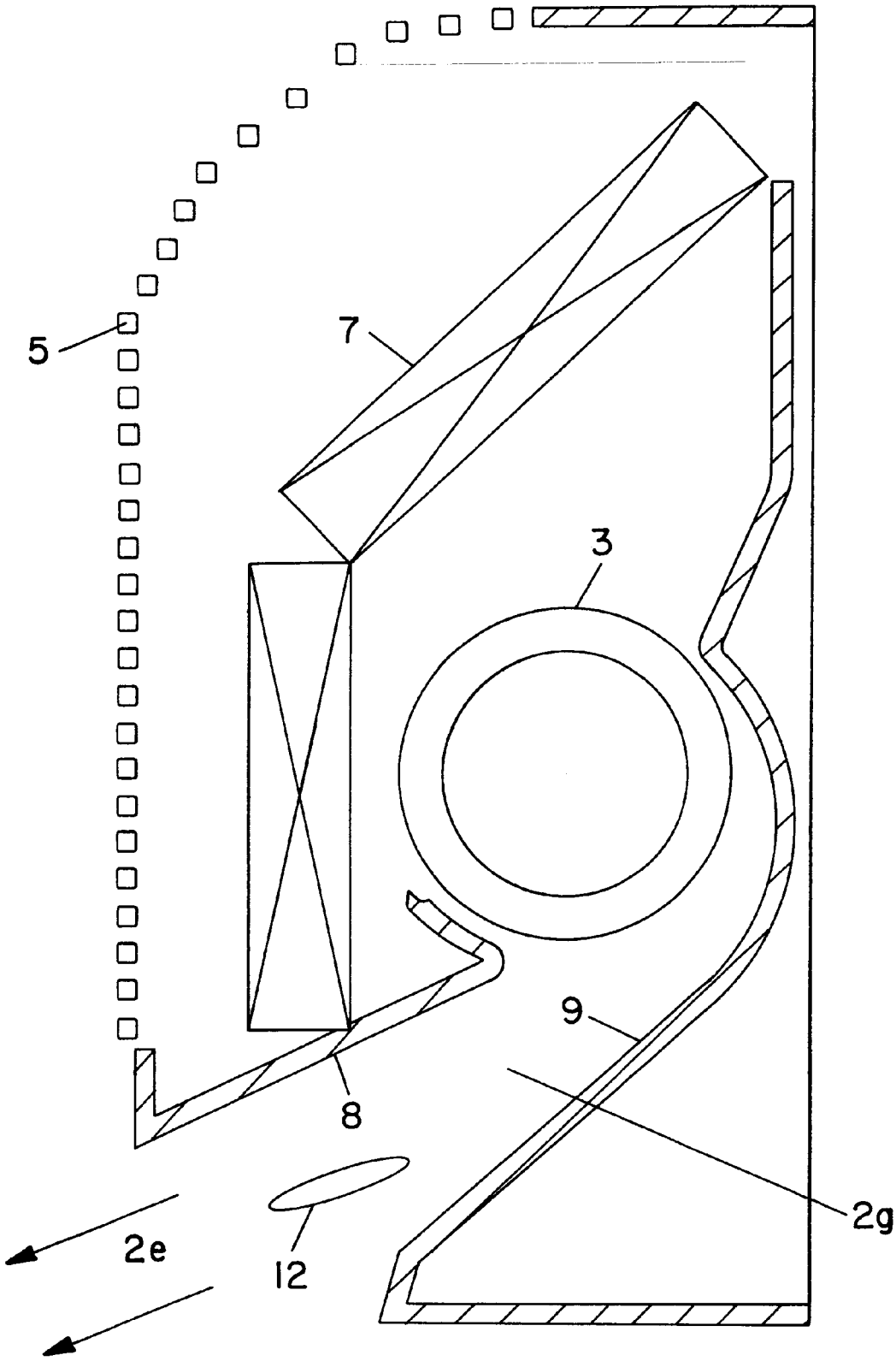
FIG. 2 is a sectional view along line 201—201 in FIG. 1.

FIG. 1 is a perspective view of an air conditioner main body 1 in an embodiment of the invention being installed in a room. A sectional view along line 201—201 in FIG. 1 is shown in FIG. 2, and a sectional view along line 202—202 in FIG. 3. The air conditioner main body 1 comprises a heat exchanger 7, a cross flow fan 3 as a blower, a front grille 5 placed at the front side, and an air diffuser 2. The air diffuser 2 and the grille 5 have an arc outer shape at the section in the horizontal direction. The air diffuser 2 has a passage 2*g* composed of a stabilizer 8 and a rear guider 9. A wind direction changer 12 is disposed in the air diffuser 2. The stabilizer 8 also serves as a water pan for handling the condensate from the heat exchanger 7. The back side of the air conditioner main body 1 is provided at a wall 303 at a position near a ceiling 302. In this constitution, the central portion 2*e* in the horizontal direction of the air diffuser 2 is at a position of projecting into the central direction of the room, and both ends 2*f* of the air diffuser 2 are positioned near the wall 303 of the room.

While the cross flow fan 3 is rotating and blowing air, the room air is sucked in from the grille 5, and exchanged of heat through a plurality of heat exchangers 7, and flows into the air diffuser 2 of arc shape through the passage 2*g*. Thus, the heat exchanged air is sent into the room from the air diffuser 2.

Figure 3:
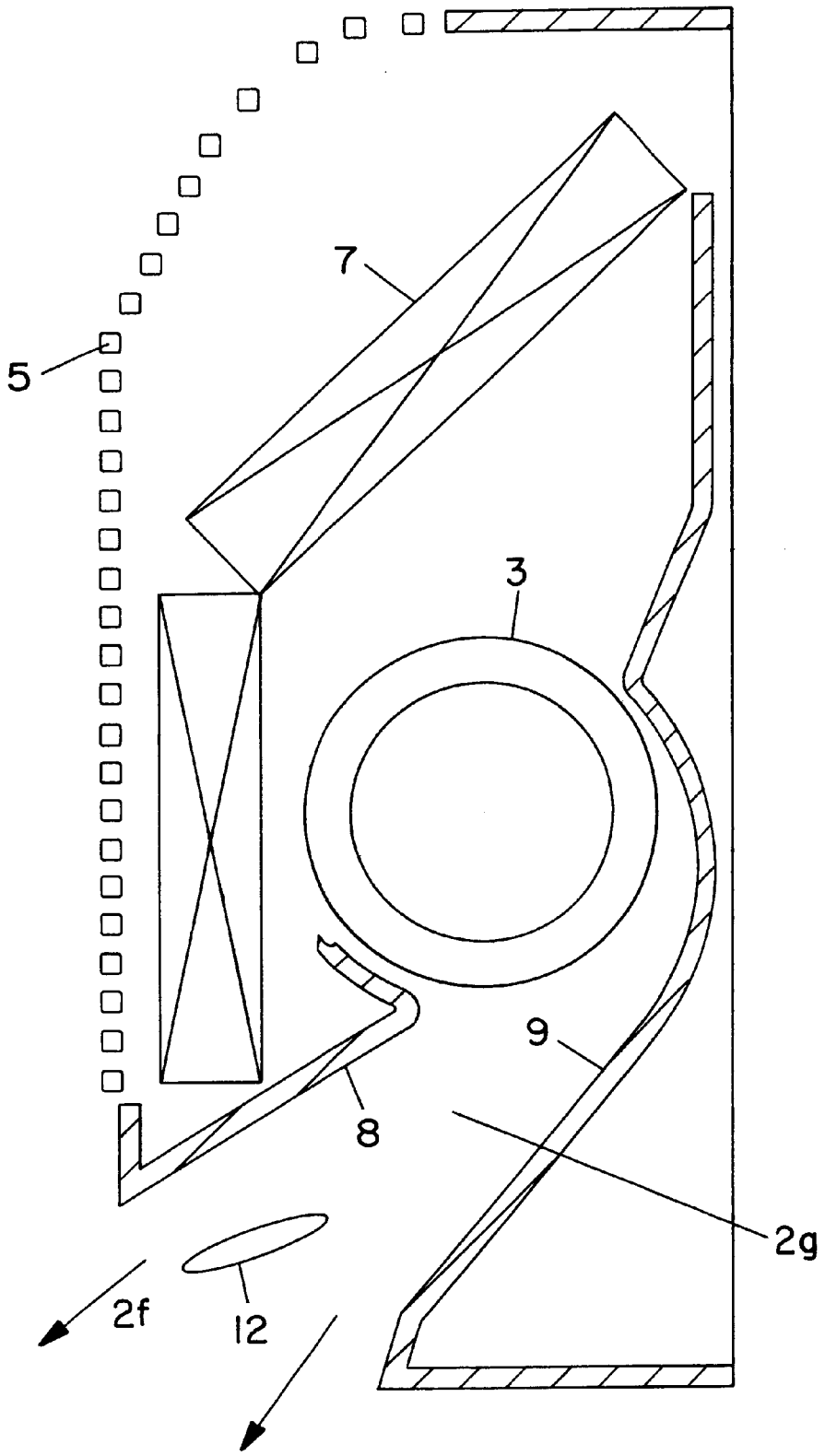
FIG. 3 is a sectional view along line 202—202 in FIG. 1.

The central portion 2*e* in the horizontal direction of the air diffuser 2 composed of the stabilizer 8 and rear guider 9 is shaped to be directed nearly in a horizontal direction, as shown in FIG. 2, so that the heat exchanged air may be blown out in a nearly horizontal direction as indicated by arrow. Further, both ends 2*f* in the horizontal direction of the air diffuser 2 are shaped to be directed in a lower direction than the central portion so that the heat exchanged wind may be blown out in a lower direction than the central portion as shown in FIG. 3. Between the central portion and the both ends, it is shaped so that the wind may be blown out gradually in the lower direction as going from the central portion to both ends. In this constitution, the wind flowing along near the room wall 303 is directed in the lower direction, while the wind flowing toward the room center is directed in the horizontal direction. That is, the heat exchanged air reaches the entire room three-dimensionally. Therefore, the heat exchanged wind reaches uniformly in every corner of the room, and the temperature of the entire room is uniform, and the comfort is enhanced notably.

Exemplary Embodiment 2

Figure 4:
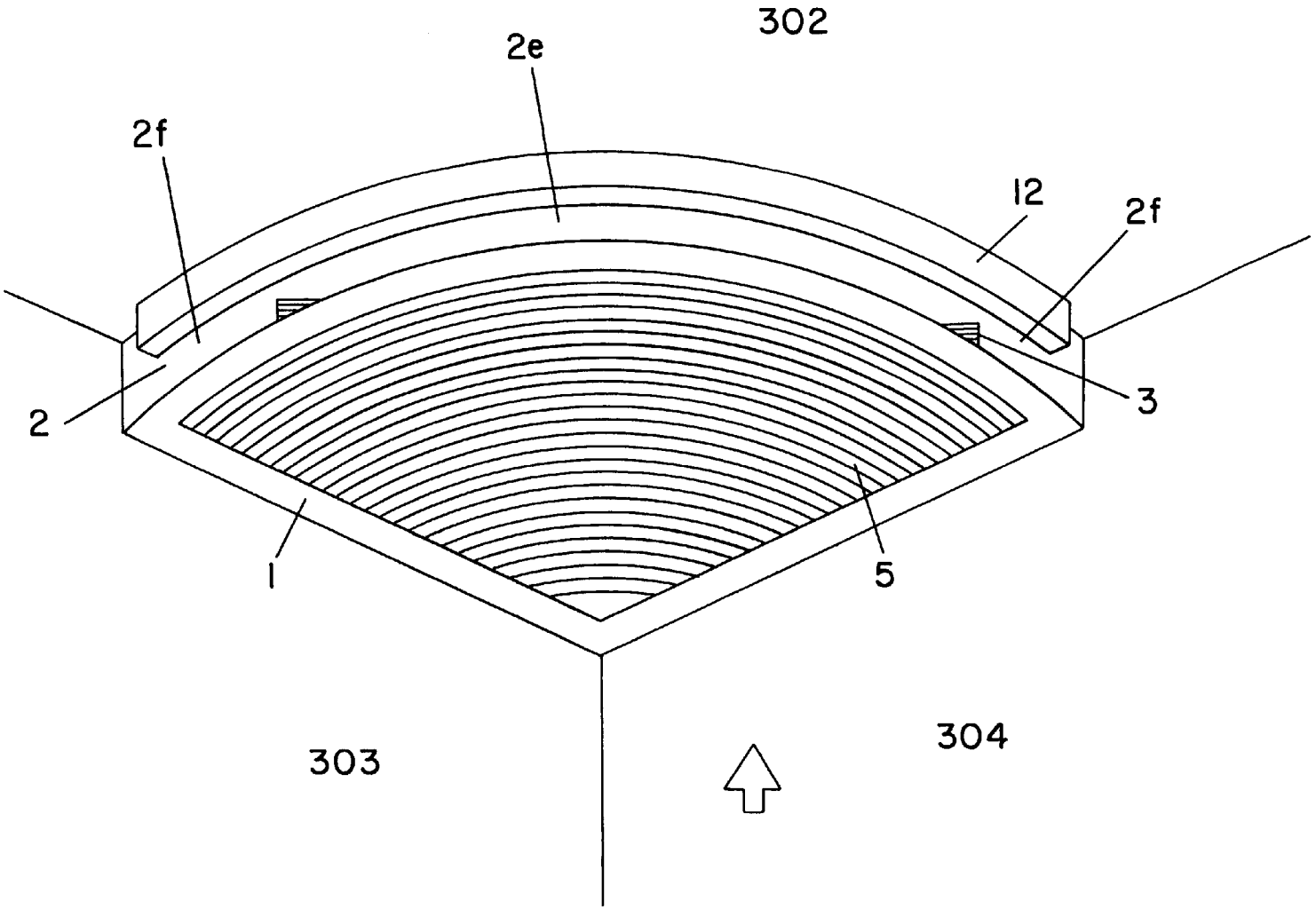
FIG. 4 is a perspective view of an air conditioner showing a second embodiment of the invention.
Figure 5:
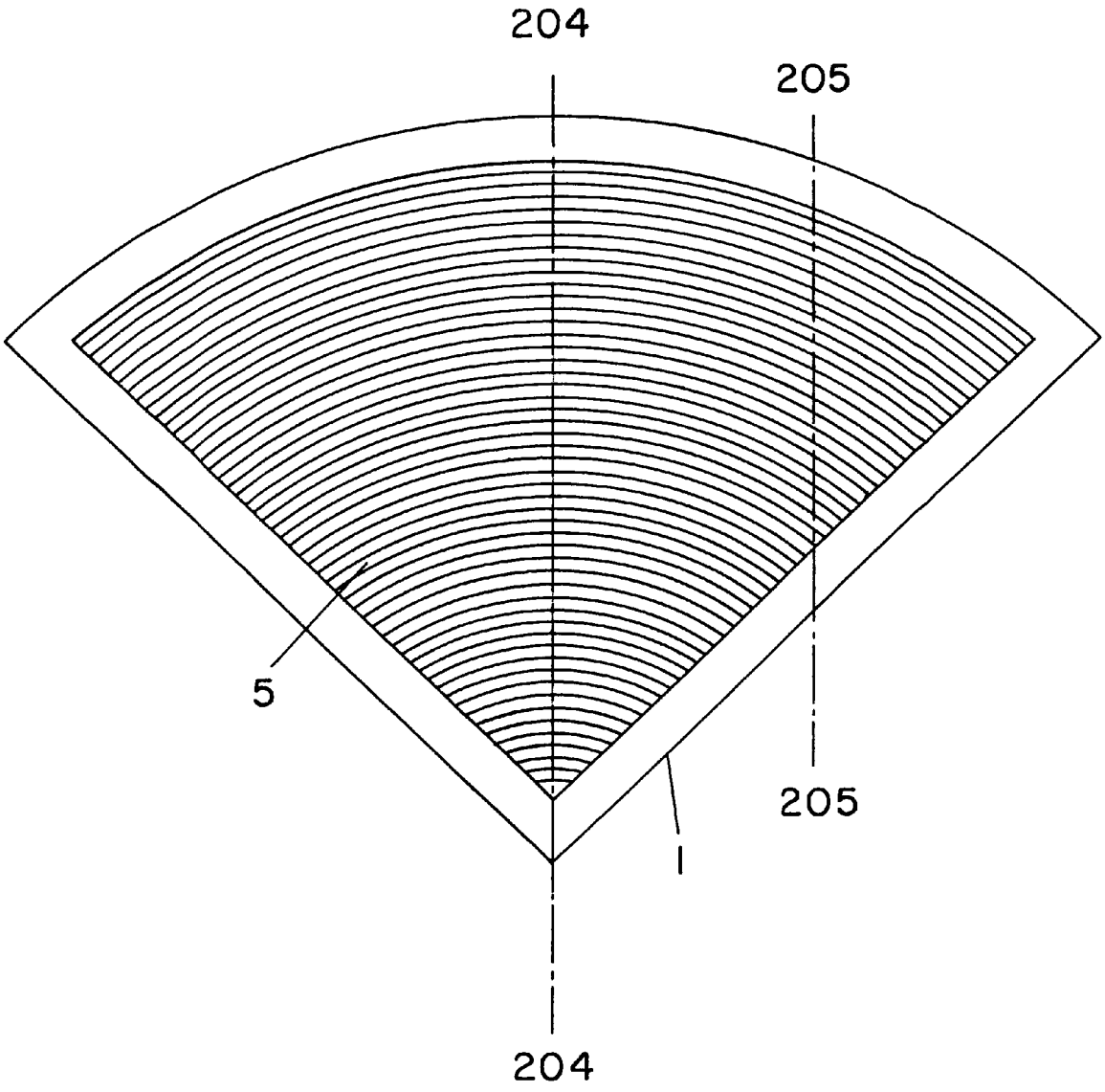
FIG. 5 is an outline plan of FIG. 4 as seen from the lower direction.

FIG. 4 is a perspective view of an air conditioner main body 1 in a second embodiment of the invention being installed in a room. FIG. 5 is a plan of FIG. 4 as seen from the lower direction. A sectional view along line 204—204 in FIG. 5 is shown in FIG. 6, and a sectional view along line 205-205 in FIG. 7.

The air conditioner main body 1 has a nearly sector shape at the section in the horizontal direction. The air conditioner main body 1 is installed closely to a corner of wall 303 and a wall 304 in the room. The air conditioner main body 1 may be also installed closely to a ceiling 302, or a space may be left between the air conditioner main body 1 and the ceiling 302. The air conditioner 1 comprises a grille 5 as a suction port disposed at the lower side, a heat exchanger 7, a cross flow fan 3 as a blower, and an air diffuser 2. The air diffuser 2 is positioned at a corner of the lower side and front side, and has an outer circumference of a quarter arc shape at the section in the horizontal direction. The air diffuser 2 has a passage 2*g* composed of a stabilizer 8 and a rear guider 9. In order that the height of the air diffuser 2 may be kept horizontal, the air conditioner main body 1 is mounted on the wall. In this state, while the cross flow fan 3 is rotating and blowing wind, the air is sucked in through the grille 5, and exchanged of heat through a plurality of heat exchangers 7, and is sent out from the arc air diffuser 2. Thus, the air conditioner 1 has a blowing action.

The air conditioner main body 1 further comprises a water pan 6 for handling the condensate from the heat exchanger, a tray 10 for handling the condensate from the heat exchange in the slope area and guiding into the water pan 6, and an internal connection piping 11. A wind direction changer 12 is in such a size as to cover the air diffuser 2, and is disposed outside of the air diffuser 2, and is designed to be movable in the vertical direction.

Figure 6:
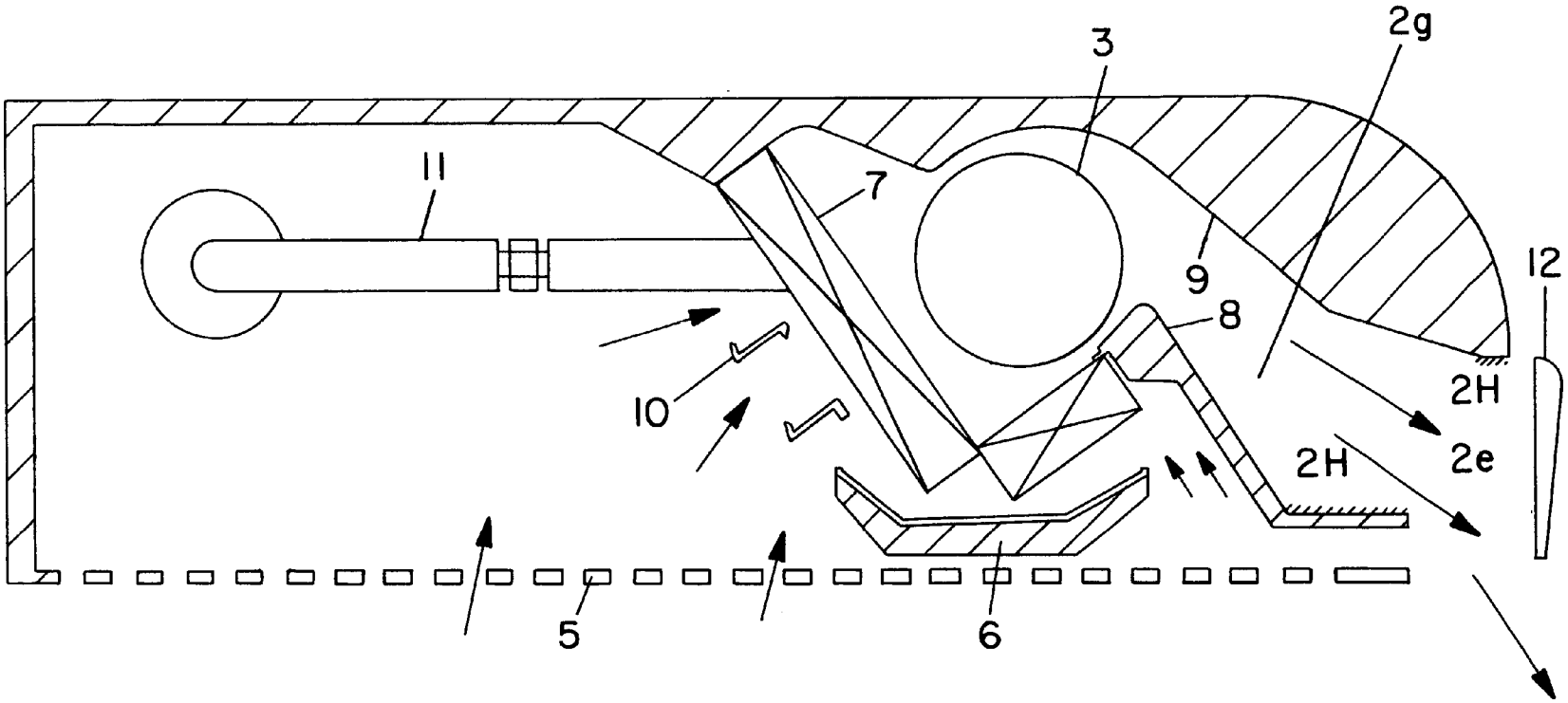
FIG. 6 is a sectional view along line 204—204 in FIG. 5.
Figure 7:
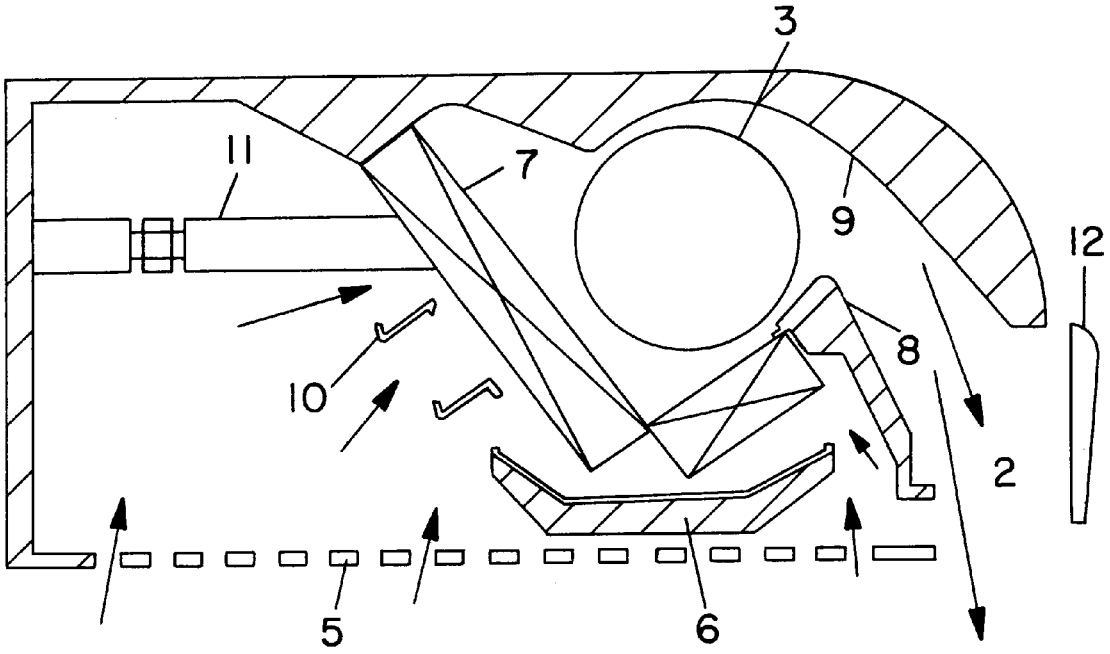
FIG. 7 is a sectional view along line 205—205 in FIG. 5.

In the air diffuser 2 composed of the stabilizer 8 and rear guider 9, the central portion 2*e* of the air diffuser 2 is composed so that the wind may be blown out in a nearly horizontal direction as shown in FIG. 6. Both ends 2*f* of the air diffuser 2 are composed so that the wind may be blown out in the lower direction as shown in FIG. 7. The air diffuser 2 is formed so that the wind being blown out may be gradually directed in the lower direction to change three-dimensionally, as going from the central portion 2*e* of the air diffuser 2 toward both ends 2*f* (section along line 205—205). In such constitution, the air flowing along near the wall is directed downward, and the air flowing toward the center of the room is directed in the horizontal direction. As a result, the heat exchanged air flow is likely to reach uniformly in the entire room, and hence the comfort is enhanced.

In FIG. 6, each one of the stabilizer 8 and rear guider 9 has a horizontal plane shape near the outlet of the air diffuser 2 (the region indicated by 2H). As going from the central portion 2*e* of the air diffuser 2 to both ends 2*f* (as approaching from the section of line 204—204 to the section of line 205—205), the region of the horizontal plane 2H in FIG. 6 retreats to the wall side. The length of the horizontal plane 2H becomes gradually shorter as going from the central portion 2*e* of the air diffuser 2 toward both ends 2*f*. Thus, by forming the air diffuser 2 controlled in the region of the horizontal plane and the length, the above effects are obtained.

Or, without forming the horizontal plane 2H of the air diffuser 2, the inclination of the air diffuser 2 may be gradually changed downward from the central portion 2*e* of the air diffuser 2 toward both ends 2*f* (from the section of line 204—204 to the section of line 205—205). That is, the inclinations of the stabilizer 8 and rear guider 9 for composing the air diffuser 2 are respectively controlled in a specified shape. In this constitution, as approaching both ends 2*f* from the central portion 2*e* of the air diffuser 2, the direction of the wind being blown out is gradually directed from the horizontal direction to the lower direction, and changes three-dimensionally. As a result, the same effects as above are obtained.

Figure 9A:
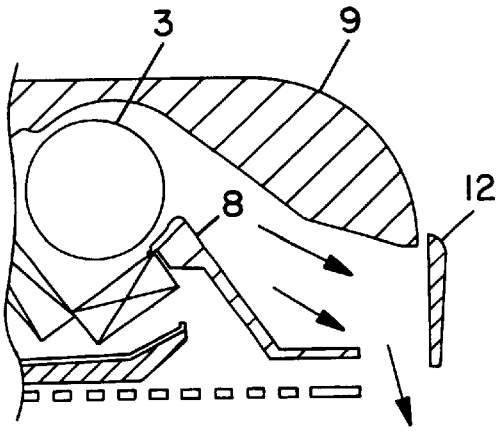
FIG. 9 is a diagram showing an air blow-out direction in FIG. 6.
Figure 9B:
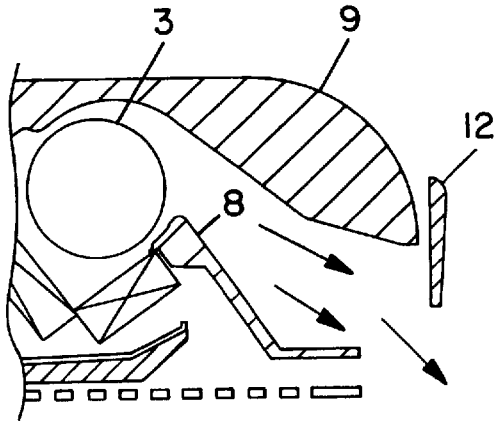
Figure 9C:
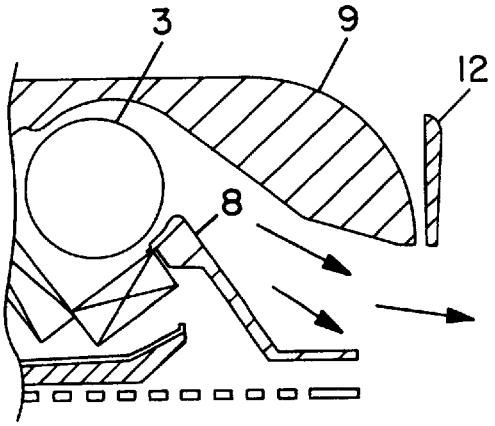

FIGS. 9 (*a*), (*b*), and (*c*) show the configuration of the air blow-out direction and the wind direction changer 12. FIG. 9 (*a*) shows the position of the wind direction changer 12 in operation stopped state (without air flow) and in air heating operation, in which the air is blown nearly in a straight downward direction. FIG. 9 (*c*) shows the position of the wind direction changer 12 in air cooling operation, in which air is blown out nearly in the horizontal direction. FIG. 9 (*b*) shows an intermediate position of FIG. 9 (*a*) and FIG. 9 (*c*), in which the air is blown out in an oblique lower direction. Thus, as the wind direction changer 12 moves up and down, the air blow-out direction can be changed nearly from the horizontal to the straight downward direction. When stopped, the since the air diffuser 2 is covered at its front, and the opening of the air diffuser 2 is not visible from the user, so that the appearance is improved. Moreover, since the wind direction changer 12 moves up and down outside of the air diffuser 2, the vertical moving range is wider, and the wind direction changing range is wider.

Figure 10:
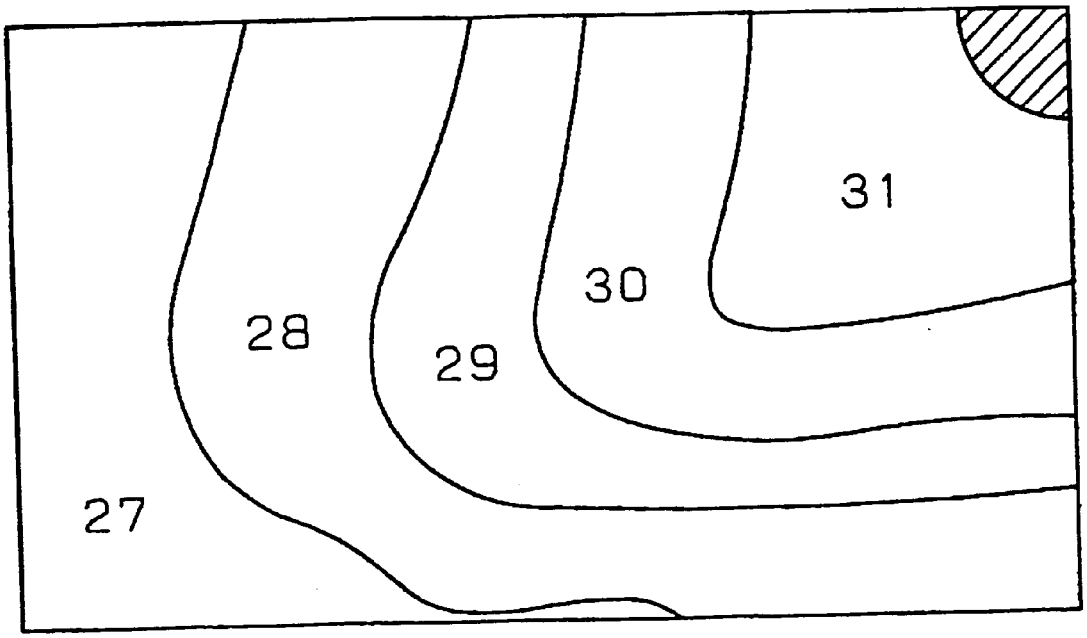
FIG. 10 is a plane temperature distribution profile in air heating operation when the air conditioner of the invention is installed at a corner of a room.
Figure 36:
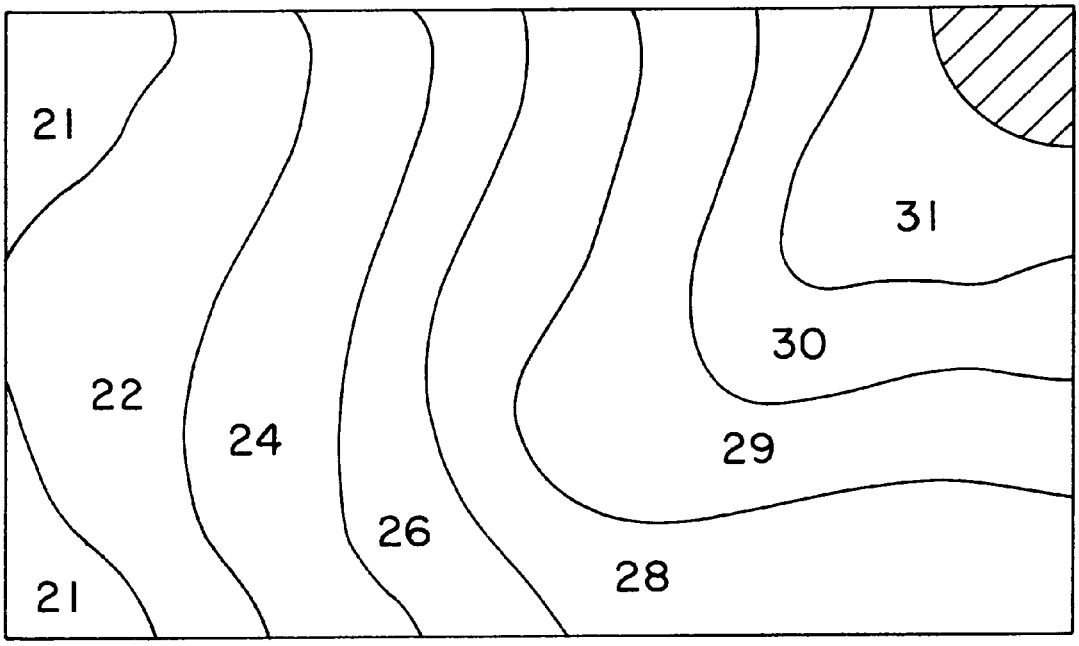
FIG. 36 PRIOR ART
FIG. 36 is a plane temperature distribution profile in air heating operation when the air conditioner of the prior art is installed at a corner of a room.

FIG. 10 shows the temperature distribution on the plane of the room in air heating operation by installing the air conditioner of the invention at a corner of a room. FIG. 36 shows the temperature distribution of a conventional air conditioner, in which the temperature is lower at near two walls to which the air conditioner is adjacent. By contrast, in FIG. 10 showing this embodiment, the temperature distribution when the air conditioner of the invention is installed, a uniform temperature distribution in the entire air is obtained, and the corners and the vicinity of the walls at the remotest positions from the air conditioner main body are warm, and the comfort is further enhanced.

Figure 8:
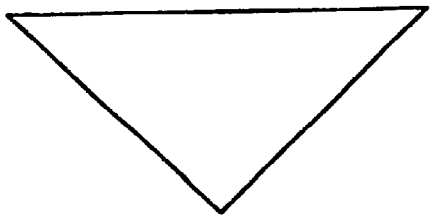
FIG. 8 is a horizontal sectional outline view of other example of a sector shape of the invention.
Figure 8:
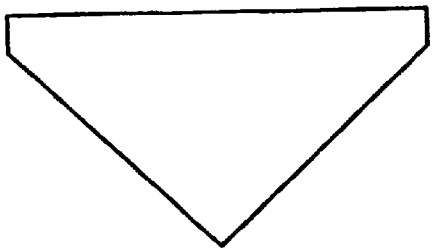
Figure 8:
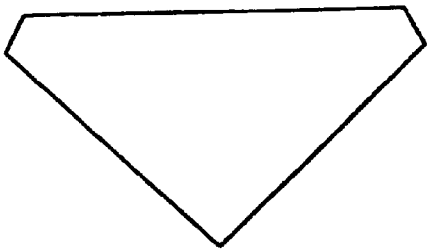
Figure 8:
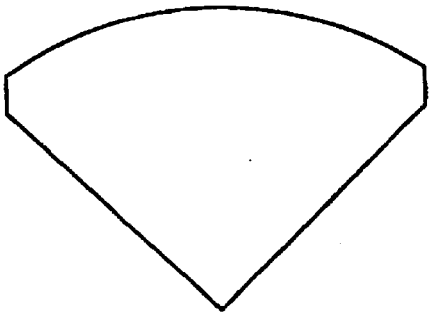

As the sector shape of the section in the horizontal direction, it is possible to form in the modes as shown in FIGS. 8 (*a*), (*b*), (*c*) and (*d*). That is, the shape of the air conditioner main body has a quarter divided shape of at least one shape selected from the group consisting of square, rectangle, circle and ellipse. It is possible to installed at a corner of mutually adjacent walls of a room, and the air diffuser may be disposed at a position directed to the inner side of the room. The air diffuser has a nearly arc or a nearly linear shape.

Exemplary Embodiment 3

Figure 11:
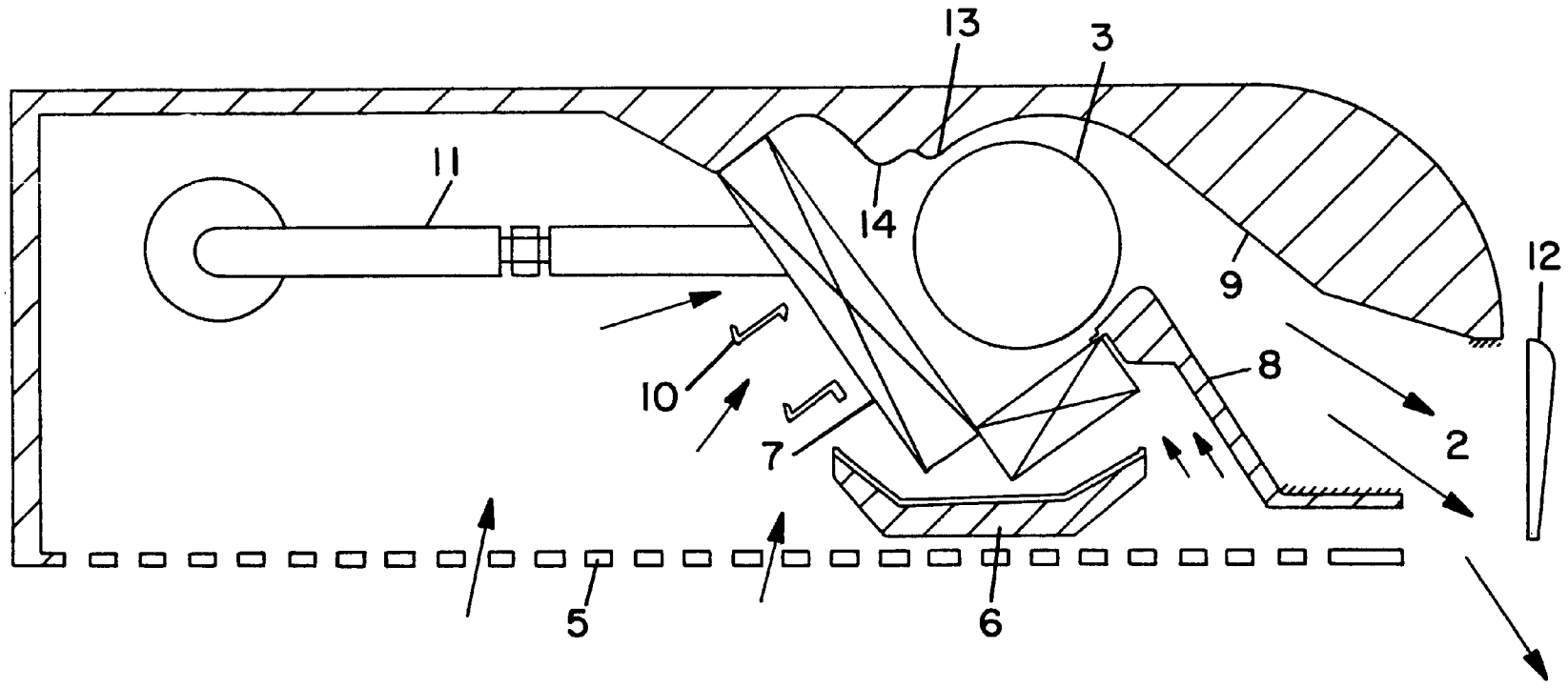
FIG. 11 is a sectional view along line 204—204 in FIG. 5 showing a third embodiment of the invention.

A third embodiment of the invention is described while referring to FIG. 11. FIG. 11 is a sectional view along line 204—204 of the central portion of the air conditioner in FIG. 5. In FIG. 11, same constituent elements as shown in FIG. 6 are identified with same reference numerals, and their description is omitted. A rear guider 9 forming a passage adjacently to as cross flow fan 3 has a first bump 13 located at the shortest distance between the cross fan 3 and rear guider 9, and a second bump 14 formed at the upstream side of the air flow of the first bump 13. The shortest distance between the second bump 14 and cross flow fan 3 is longer than the shortest distance of the first bump 13 and cross flow fan 3. In this constitution, the air suction volume flowing into the cross flow fan 3 is controlled. Therefore the balance of the air suction volume and discharge volume is even, so that generation of unusual sound at high load can be prevented.

Exemplary Embodiment 4

Figure 12:
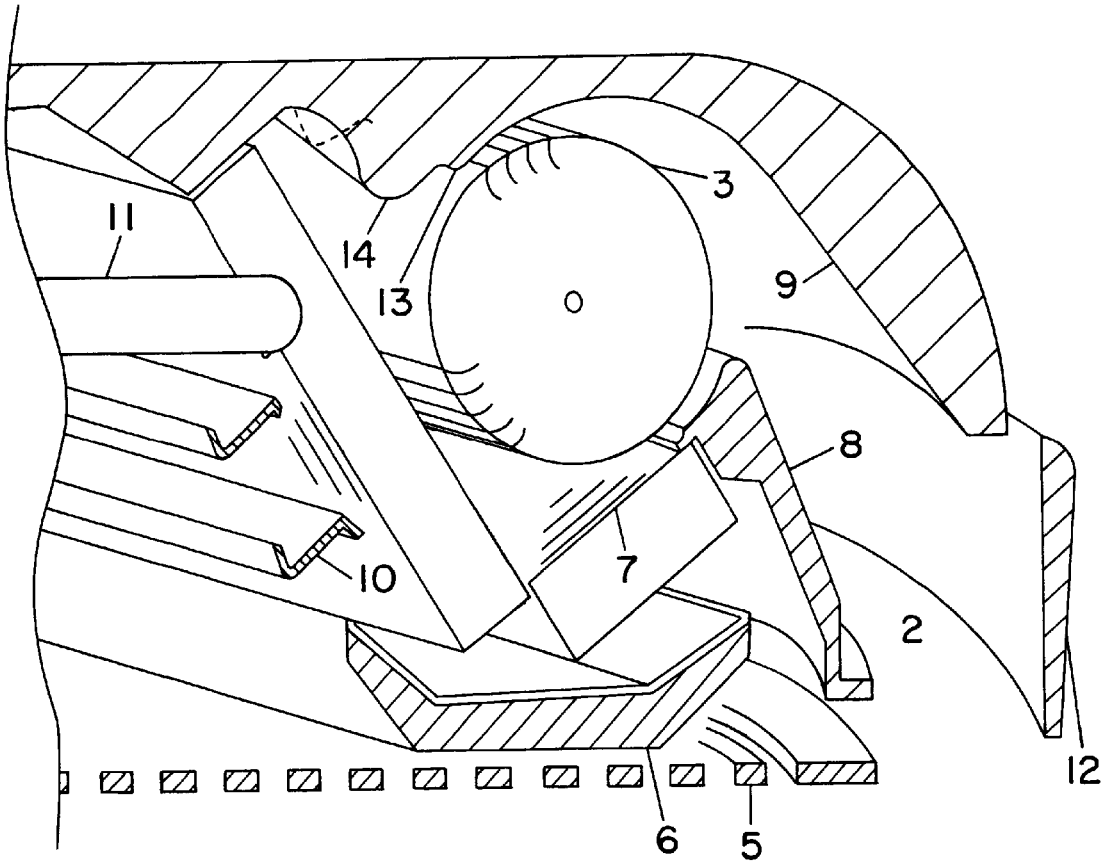
FIG. 12 is a perspective sectional view along line 205—205 in FIG. 5 showing a fourth embodiment of the invention.

20 A fourth embodiment of the invention is described while referring to FIG. 12. FIG. 12 is a sectional view along line 205—205 of both ends of the air conditioner in FIG. 5. Same constituent elements as shown in FIG. 6 are identified with same reference numerals, and their description is omitted. The end portion of the second bump 14 is larger than in the central portion in the longitudinal direction of the passage. In this constitution, the complicated flow at the end portion is improved, and generation of unusual buzzing sound from the end portion is canceled.

The bulging of the end portion of the second bump 14 may be formed either at one side or at both sides.

Exemplary Embodiment 5

Figure 13:
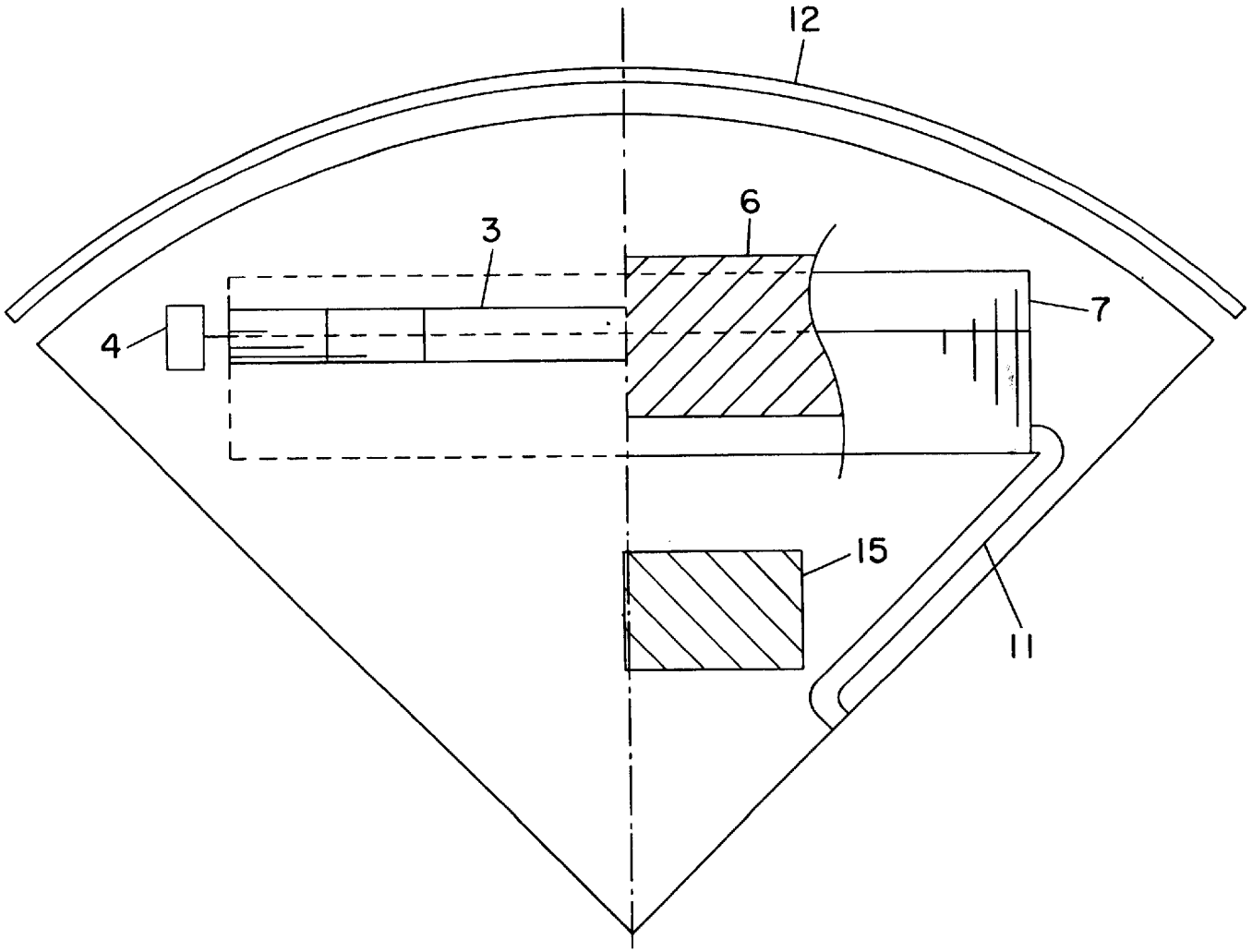
FIG. 13 is an essential plan of FIG. 4 as seen from the lower direction showing a fifth embodiment of the invention.
Figure 14:
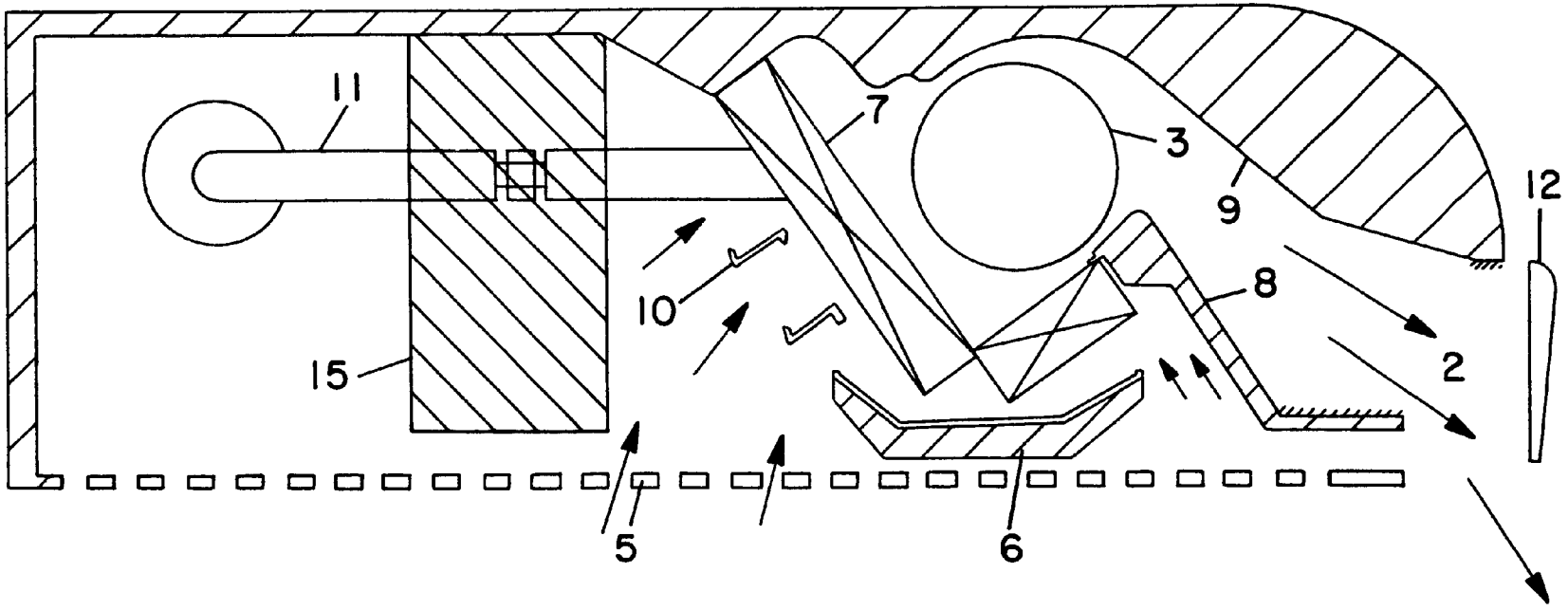
FIG. 14 is a sectional view along line 204—204 in FIG. 5 showing the fifth embodiment of the invention.

A fifth embodiment of the invention is described while referring to FIG. 13 and FIG. 14. FIG. 13 is an essential plane sectional view of FIG. 4 as seen from the lower direction. Same constituent elements as shown in FIG. 6 are identified with same reference numerals, and their description is omitted. An electrical part 15 is installed in the space between the downstream side of the grille 5 and the upstream side of the heat exchanger 7. FIG. 14 shows a sectional view along line 204—204 in the central portion of FIG. 5, and the electrical part 15 is installed away from the heat exchanger 7, and the effect of the electrical part on the suction of air into the heat exchanger 7 is kept to a minimum limit. By positioning the electrical part 15 in this area, the space can be utilized effectively, and a compact air conditioner is obtained. Besides, the electrical part is cooled. Further, the conventional electrical part can be used as a common part, and the cost is saved.

Exemplary Embodiment 6

Figure 15:
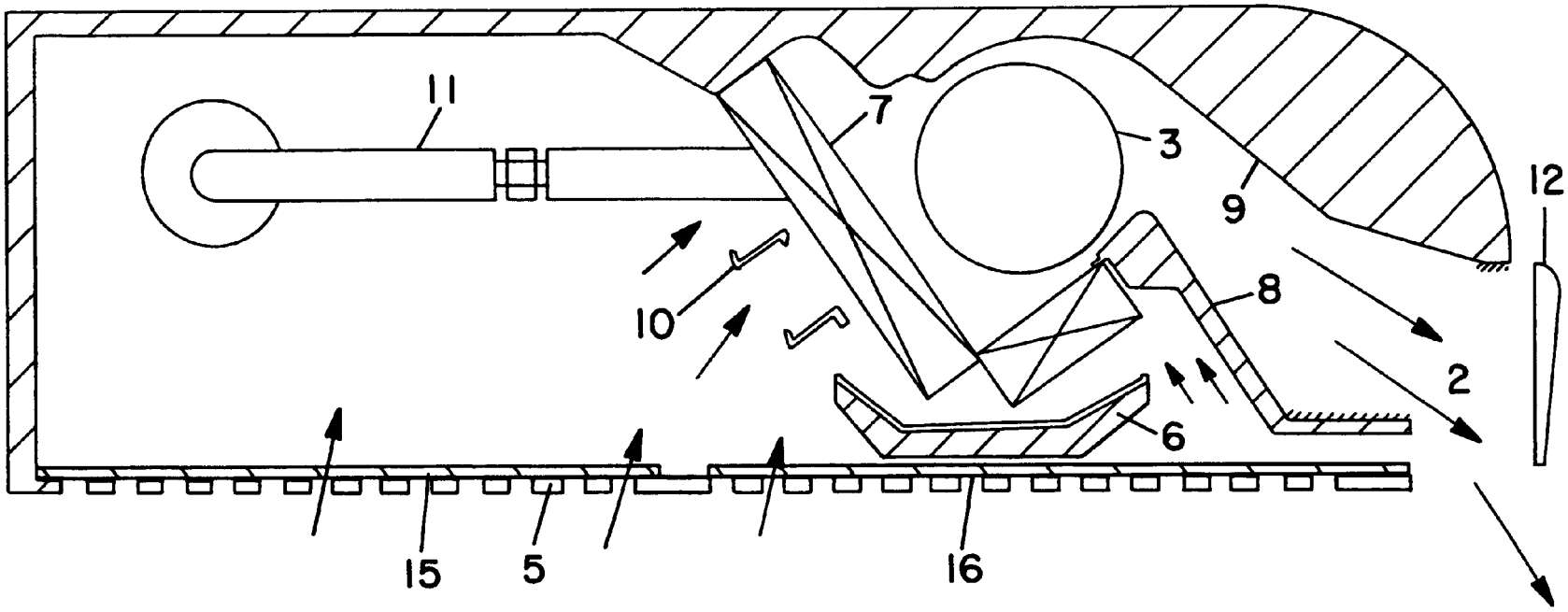
FIG. 15 is a sectional view along line 204—204 in FIG. 5 showing a sixth embodiment of the invention.

A sixth embodiment of the invention is described while referring to FIG. 15. FIG. 15 is a sectional view along line 204—204 in the central portion of FIG. 5. Same constituent elements as shown in FIG. 6 are identified with same reference numerals, and their description is omitted. A filter 16 is placed horizontally between a grille 5 as a suction port and a water pan 6 for processing the condensate from a heat exchanger 7. The filter 16 is divided into two parts, so that it can be removed easily when cleaning. By this filter 16, the room dust can be removed easily. Besides, an economical filter shape can be employed, and the material cost is saved.

Exemplary Embodiment 7

Figure 16:
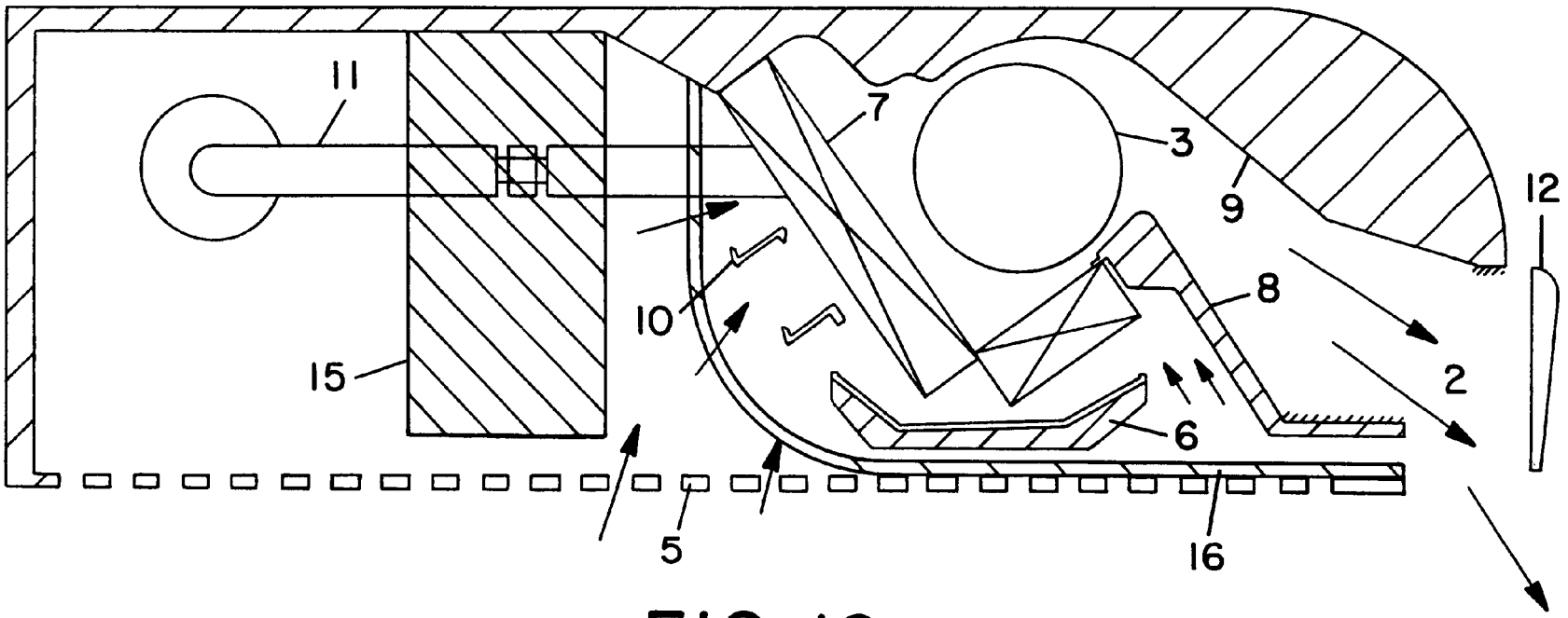
FIG. 16 is a sectional view along line 204—204 in FIG. 5 showing a seventh embodiment of the invention.

A seventh embodiment of the invention is described while referring to FIG. 16. FIG. 16 is a sectional view along line 204—204 in the central portion of FIG. 5. Same constituent elements as shown in FIG. 6 are identified with same reference numerals, and their description is omitted. A filter 16 is placed in an L-shape between a grille 5 as a suction port and a water pan 6 for processing the condensate from a heat exchanger 7, and between an inclined tray 10 for handling the condensate water of the heat exchanger 7 and an electrical part 15. The filter 16 is provided in a form for surrounding the circumference of the heat exchanger 7, so that the dust getting in from the piping hole or tiny clearance in the air conditioner main body 1 can be cleaned thoroughly. Besides, by detaching the grille, the piping connection work, drain work and other work are easy.

This filter 16 may be also composed of a plurality of filters.

Exemplary Embodiment 8

Figure 17:
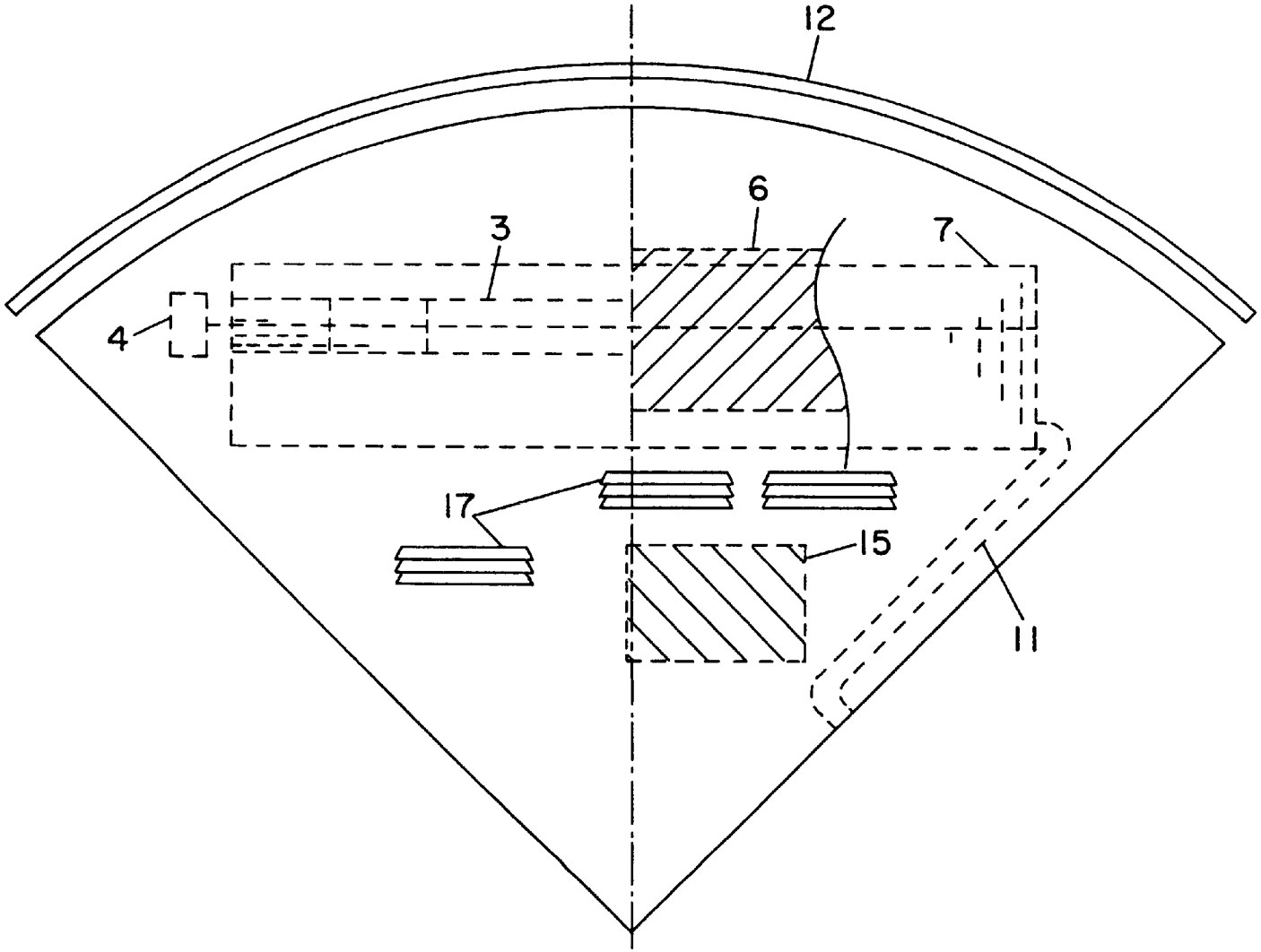
FIG. 17 is a plan of FIG. 4 as seen from the ceiling side showing an eighth embodiment of the invention.

An eighth embodiment of the invention is described while referring to FIG. 17. FIG. 17 is a plan of FIG. 4 as seen from the ceiling side. A louver 17 is placed in the ceiling portion of the air conditioner main body 1. In an internal connection piping 11 at the upstream side of an air flow of a heat exchanger 7 and in the upper direction of an accommodating compartment of an electrical part 15, a plurality of louvers 17 are placed. In this constitution, the suction volume of air entering from the gaps increases, and the air conditioning performance and air blowing force are enhanced. Moreover, generation of unusual buzzing sound at high load can be canceled.

Exemplary Embodiment 9

Figure 18:
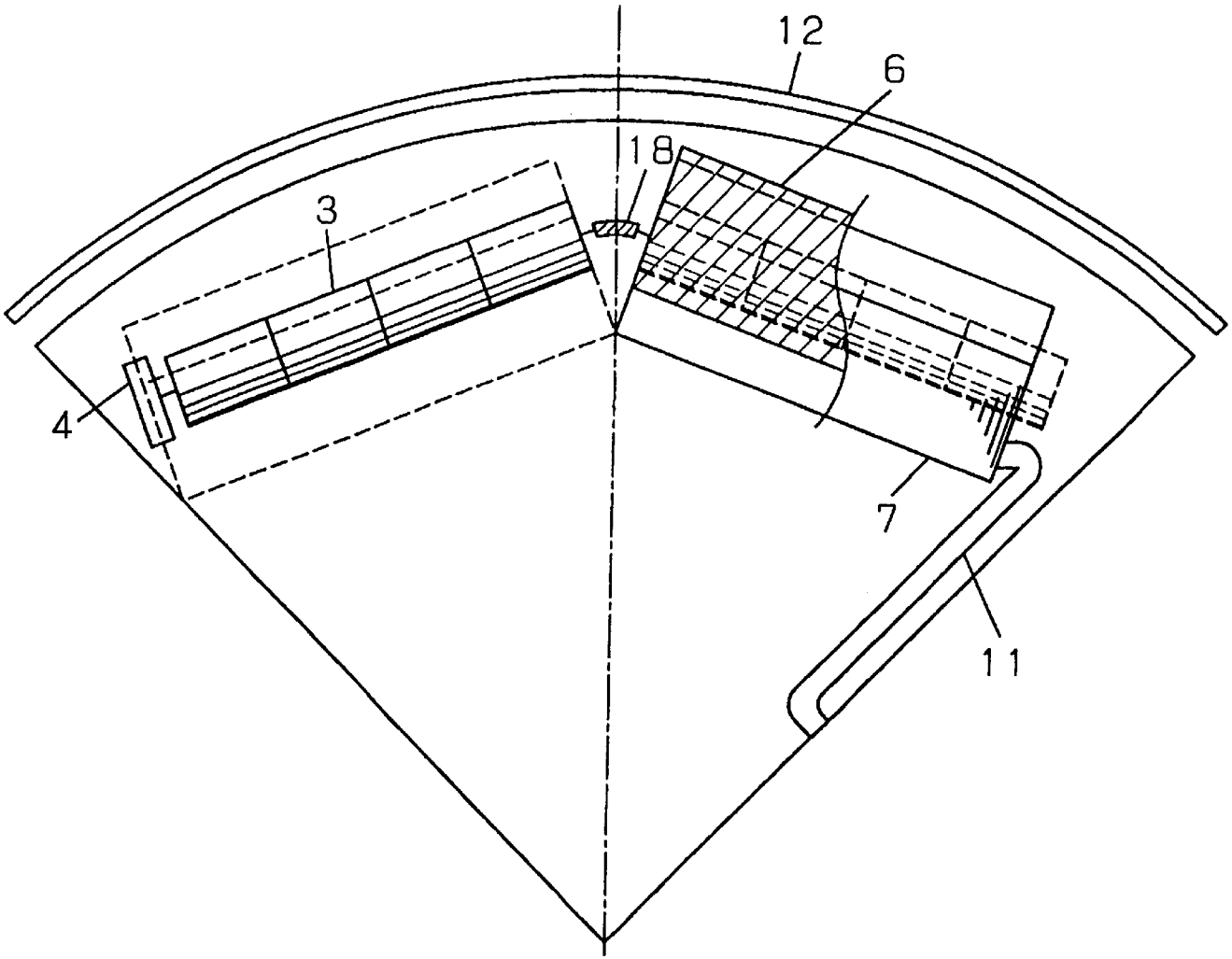
FIG. 18 is an essential plane sectional view of FIG. 4 as seen from the lower direction showing a ninth embodiment of the invention.

A ninth embodiment of the invention is described while referring to FIG. 18. FIG. 18 is an essential plane sectional view of FIG. 4 as seen from the lower direction. Same constituent elements as shown in FIG. 6 are identified with same reference numerals, and their description is omitted. Two cross fans 3 are coupled through a universal joint 18, and are disposed in an arc form along an air diffuser 2. In this constitution, the length of the cross flow fans 3, and the area of the heat exchanger 7 are increased. Accordingly, the air conditioning performance is enhanced, and the air conditioner main body 1 is formed in a further compact body. Moreover, since the air is blown out at a wide angle from the air diffuser, the comfort is enhanced.

Incidentally, more than two cross flow fans 3 can be coupled, and in to this constitution, too, the same effects as above are obtained.

Exemplary Embodiment 10

Figure 19:
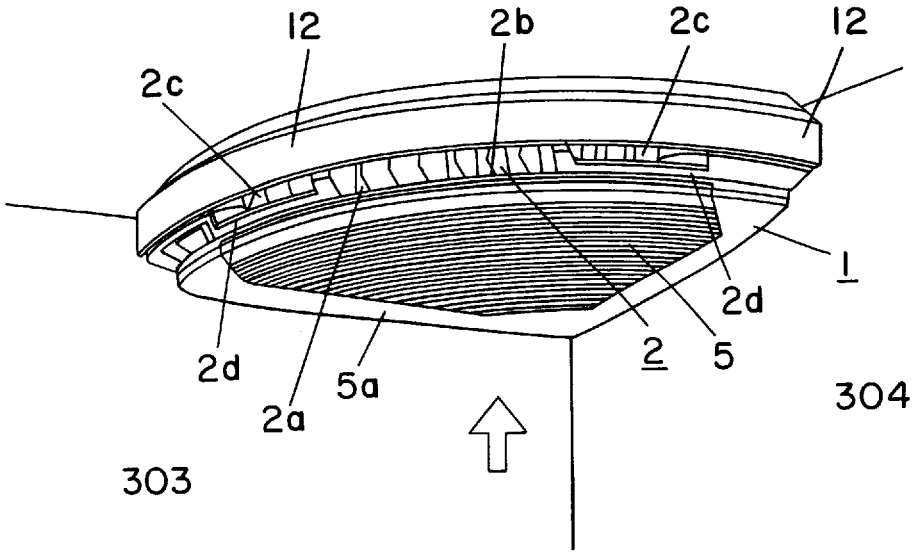
FIG. 19 is a perspective view of an air conditioner showing a tenth embodiment of the invention.
Figure 20:
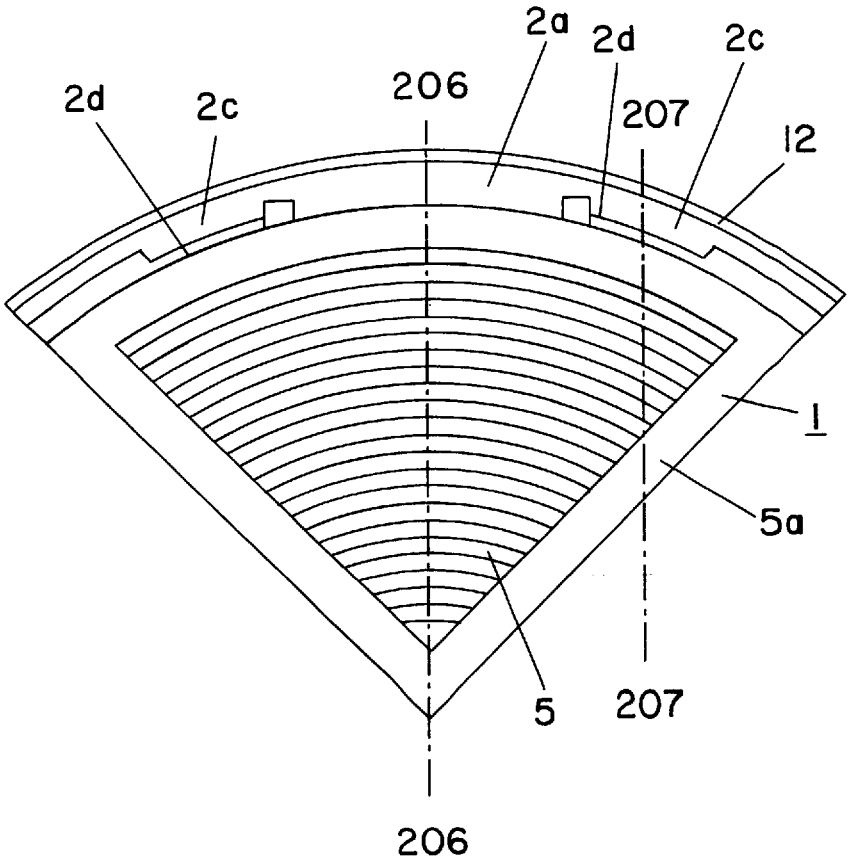
FIG. 20 is a plane outline view of FIG. 19 as seen from the lower direction.
Figure 21:
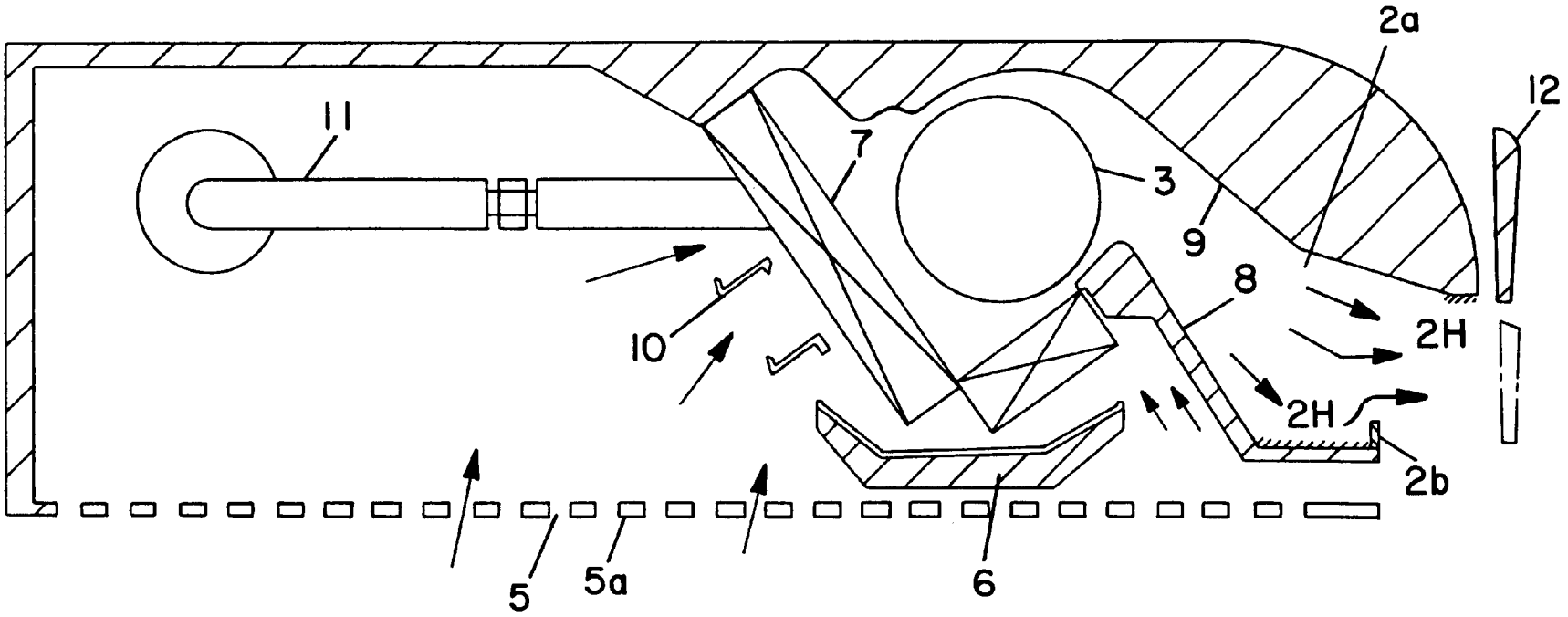
FIG. 21 is a sectional view along line 206—206 in FIG. 20.
Figure 22:
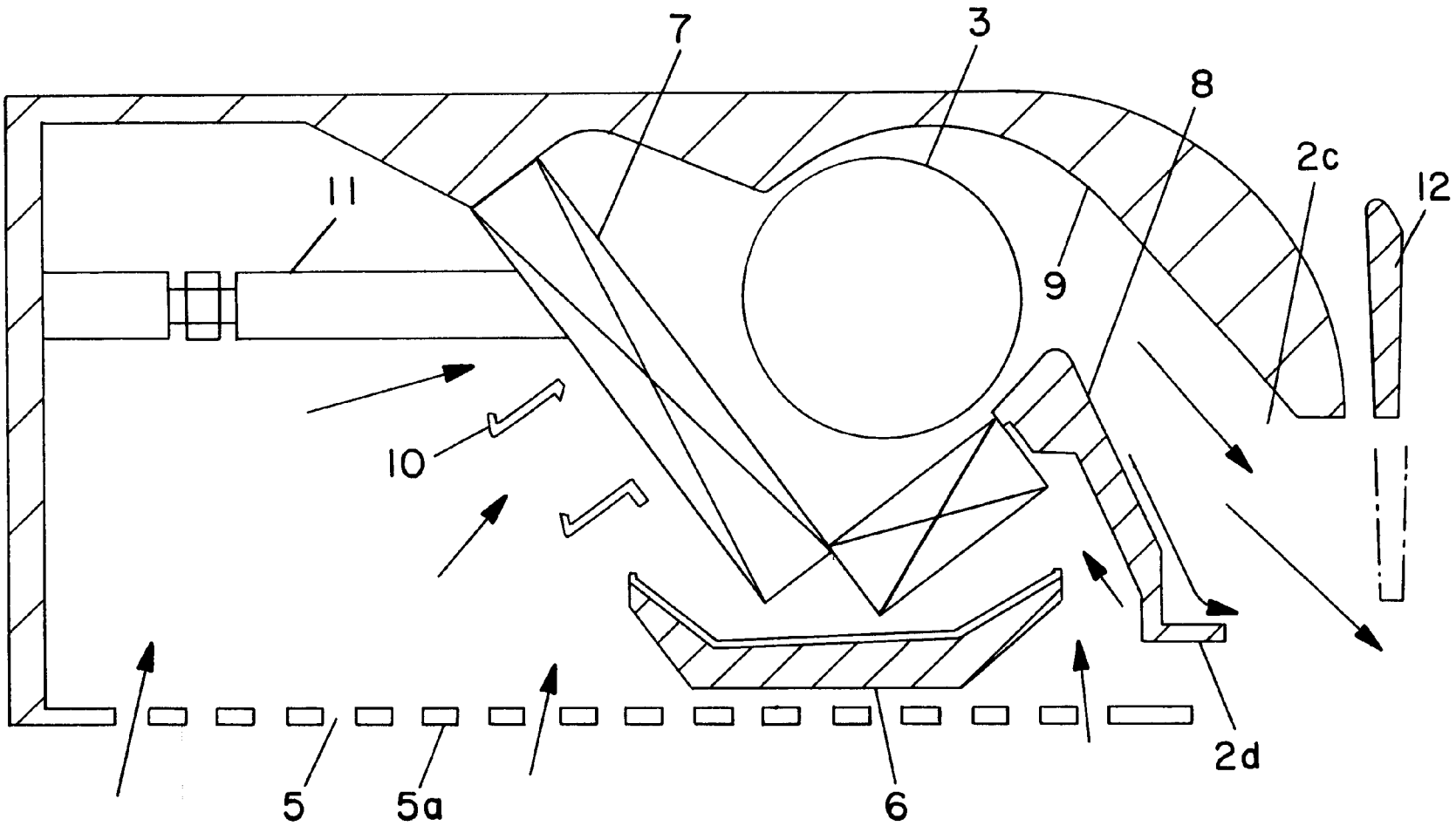
FIG. 22 is a sectional view along line 207—207 in FIG. 20.
Figure 23A:
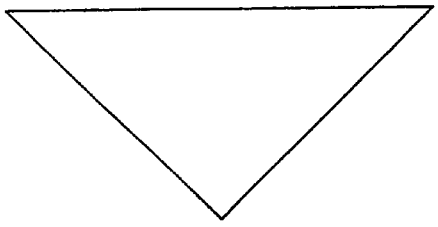
FIG. 23 is a horizontal sectional outline view of other example of a sector shape.
Figure 23B:
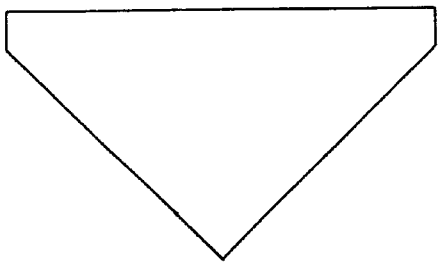
Figure 23C:
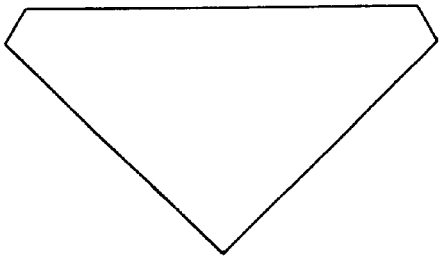
Figure 23D:
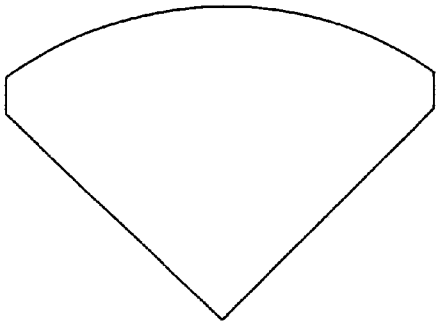

FIG. 19 is a perspective view of installation of an air conditioner in an embodiment of the invention in a room. FIG. 20 is a plan of FIG. 19 as seen from the lower direction. FIG. 21 is a sectional view along line 206—206 in FIG. 20, and FIG. 22 is a sectional view along line 207—207.

An air conditioner main body 1 has a nearly sector shaped section in the horizontal direction. This air conditioner main body 1 is installed closely to a corner of a ceiling 302 in a room and two walls 303, 304. It has a suction port in the lower direction, and an air diffuser 2 in the arc shaped portion. While a cross flow fan 3 as a blower is rotating and blowing air, the air is sucked in from a grille 5 as a suction port 5*a* at the lower side, and is exchanged of heat through a plurality of heat exchangers 7, and flows into the arc shaped air diffuser 2. Thus, it has a blowing action. The air conditioner main body 1 incorporates a water pan 6 for handling the condensate of the heat exchangers, a tray 10 for handling the condensate of the heat exchanger 7 in the slope portion and guiding into the water pan 6, an internal connection piping 11, and a wind direction changer 12.

The air diffuser 2 has a passage composed of a stabilizer 8 and a rear guider 9. The air diffuser 2 comprises a horizontal air diffuser 2*a* directed nearly in a horizontal direction in the central portion in the horizontal direction, a leading end bump 2*b* having an arbitrary height placed at the leading end of a 2H portion at the lower side of the horizontal air diffuser 2*a,* a downward air diffuser 2*c* inclined downward from the central portion at both ends in the horizontal direction, and a straightening plate 2*d* extended nearly in a horizontal direction placed at the lower side leading end of the downward air diffuser 2*c*. The horizontal portion 2H in FIG. 21 has a nearly horizontal shape, and as approaching the section of line 207—207 at both sides from the section of line 206—206 in the central portion of the air diffuser 2, the horizontal portion 2H is positioned at a position gradually retreating to the wall side. As approaching the section of line 207—207 at both ends from line 206—206 in the central portion, the air diffuser 2 is gradually changed three-dimensionally so as to be directed in the lower direction. The height of the air diffuser 2 is held horizontally.

In the horizontal air diffuser 2*a* in the central portion of the air diffuser 2, the wind hitting against the leading end bump 2*b* has a velocity vector in the horizontal direction, and the air flowing toward the central portion of the room is more likely to be directed in the horizontal direction. At both ends of the air diffuser 2, by disposing the downward air diffuser 2*c* inclined downward from the central portion and the straightening plate 2*d* placed in the downward air diffuser 2*c,* short-circuit can be prevented by the wall Coanda effect. The air flowing along near the wall is blown from the lower direction to the range of the horizontal direction. In this constitution, the heat exchanged aid reaches the entire room. As a result, the temperature distribution in the room is uniform, and the comfort is notably enhanced.

The air conditioner main body having a nearly sector shape in the horizontal section may be also formed as shown in FIG. 23.

Figure 24:
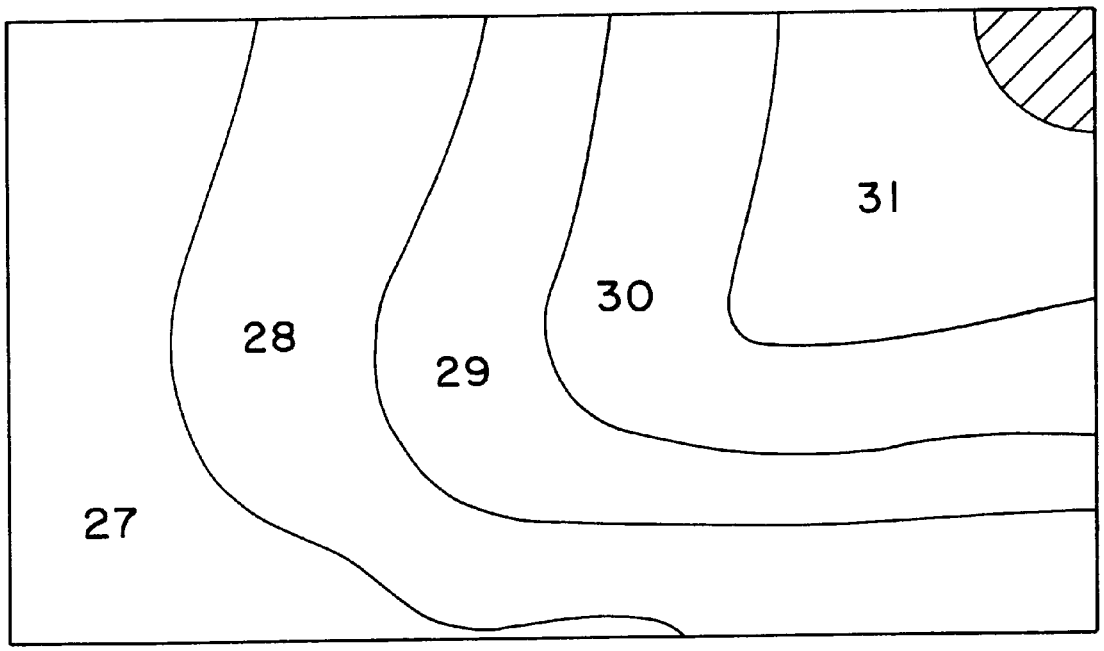
FIG. 24 is a plane temperature distribution profile in air heating operation when the air conditioner of the invention is installed at a corner of a room.

FIG. 24 shows the plane temperature distribution of the room in air heating operation by installing the air conditioner of the embodiment at a corner of the room. FIG. 36 shows the temperature distribution of a conventional air conditioner, in which the warm air does not reach the corners of the room, and the comfort is poor. By contrast, FIG. 24 shows the temperature distribution when the air conditioner of the embodiment is installed, in which a uniform temperature distribution is obtained, and the warm air reaches the corners of the room, and the comfort is notably enhanced.

Exemplary Embodiment 11

Figure 25:
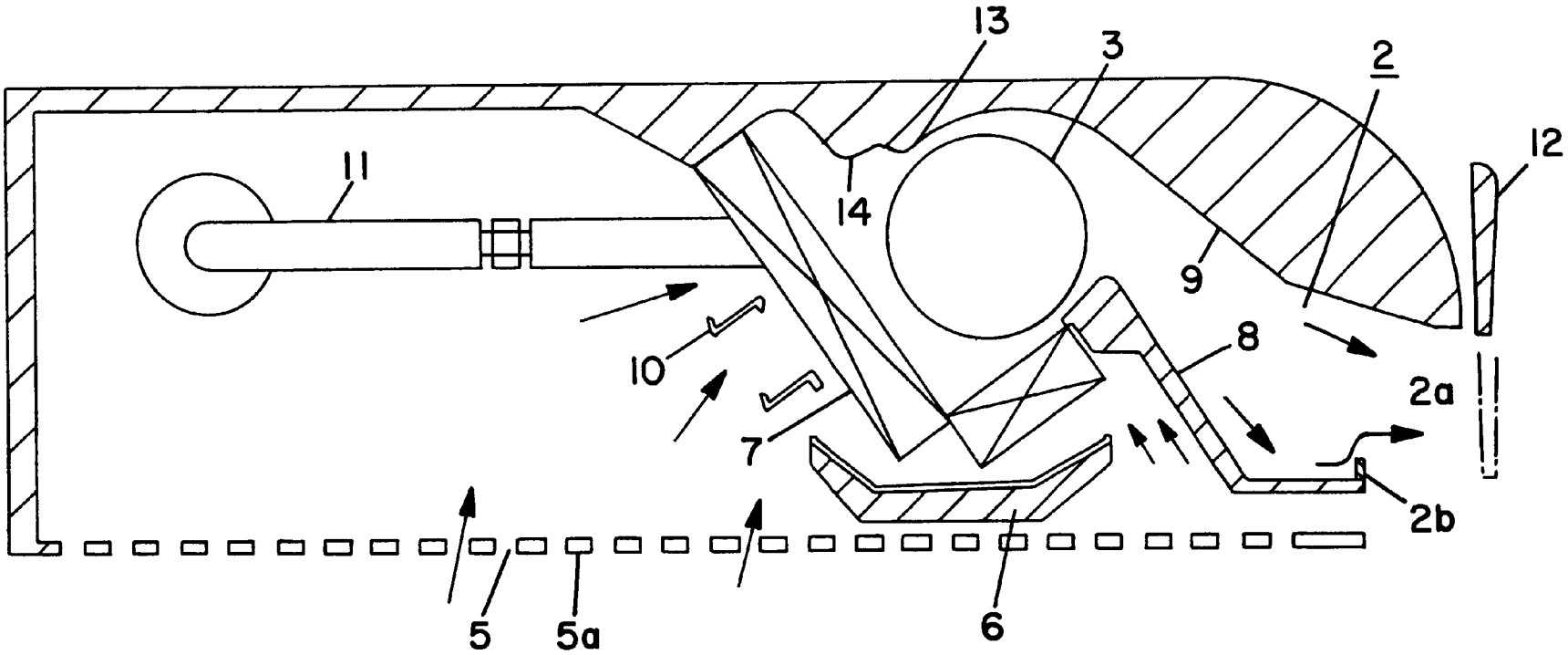
FIG. 25 is a sectional view along line 206—206 in FIG. 20 showing an eleventh embodiment of the invention.

Vito Other embodiment of the invention is described in FIG. 25. FIG. 25 is a sectional view along line 206—206 of the air conditioner in FIG. 20. Same constituent elements as shown in FIG. 21 are identified with same reference numerals, and their description is omitted. A rear guider 9 forms a passage adjacently a cross flow fan 3. The passage has a first bump 13 formed at a position where the distance between the cross flow fan 3 and the rear guider 9 is the shortest, and a second bump 14 formed at the upstream side of the air flow of the first bump 13. The distance between the second bump 14 and the cross flow fan 3 is longer than the distance between the first bump and the cross flow fan 3. In such constitution, the suction volume of the air flowing into the cross flow fan 3 is reduced. As a result, the air blowing performance is enhanced. Further, generation of unusual sound is suppressed.

Exemplary Embodiment 12

Figure 26:
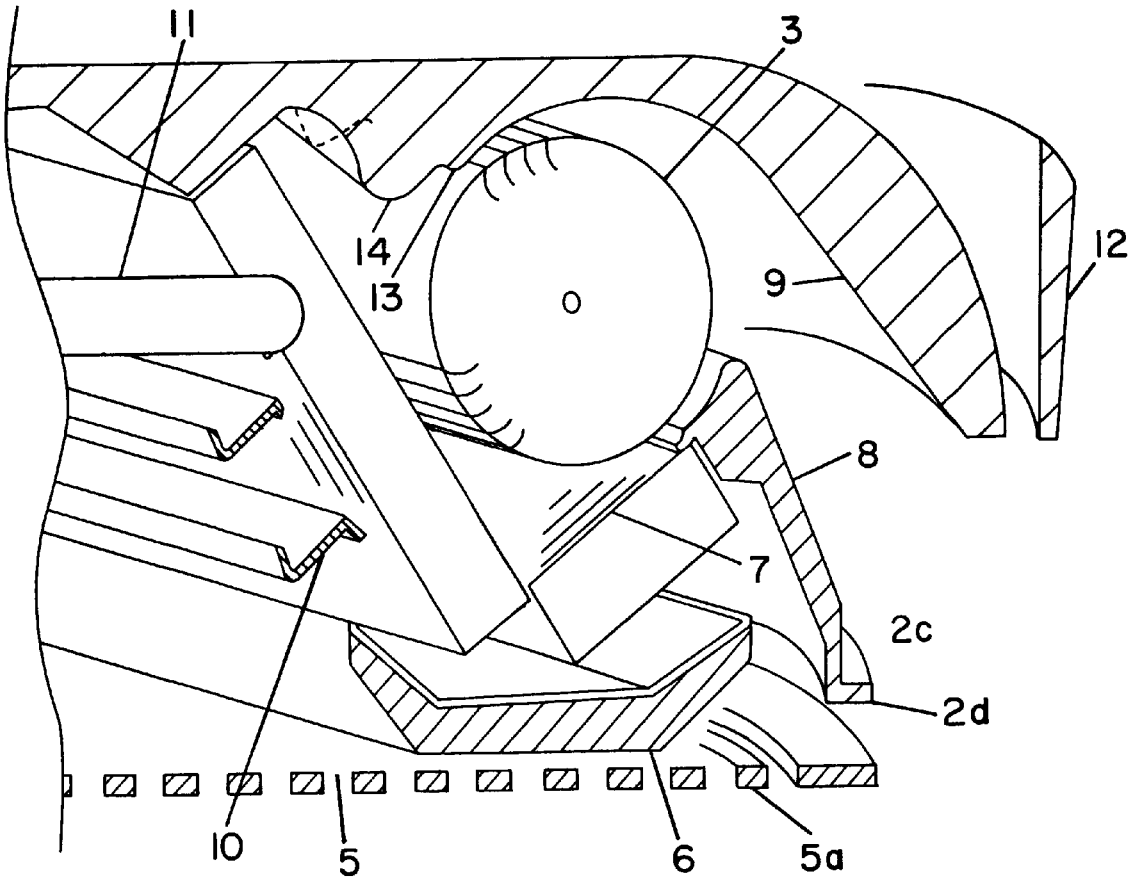
FIG. 26 is a perspective view of a section along line 207—207 in FIG. 20 showing a twelfth embodiment of the invention.

A different embodiment of the invention is described in FIG. 26. FIG. 26 is a sectional perspective view along line 207—207 of the air conditioner in FIG. 20. Same constituent elements as shown in FIG. 21 are identified with same reference numerals, and their description is omitted. Both ends of a second bump 14 have a shape larger than the central portion. In this constitution, the complicated flow in the end portion is improved, and the unusual buzzing sound generated from the end portion is canceled.

The bulging of the end portion of the bump 14 may be formed at either one side or both sides, and in this constitution the same effects as above are obtained.

Exemplary Embodiment 13

Figure 27:
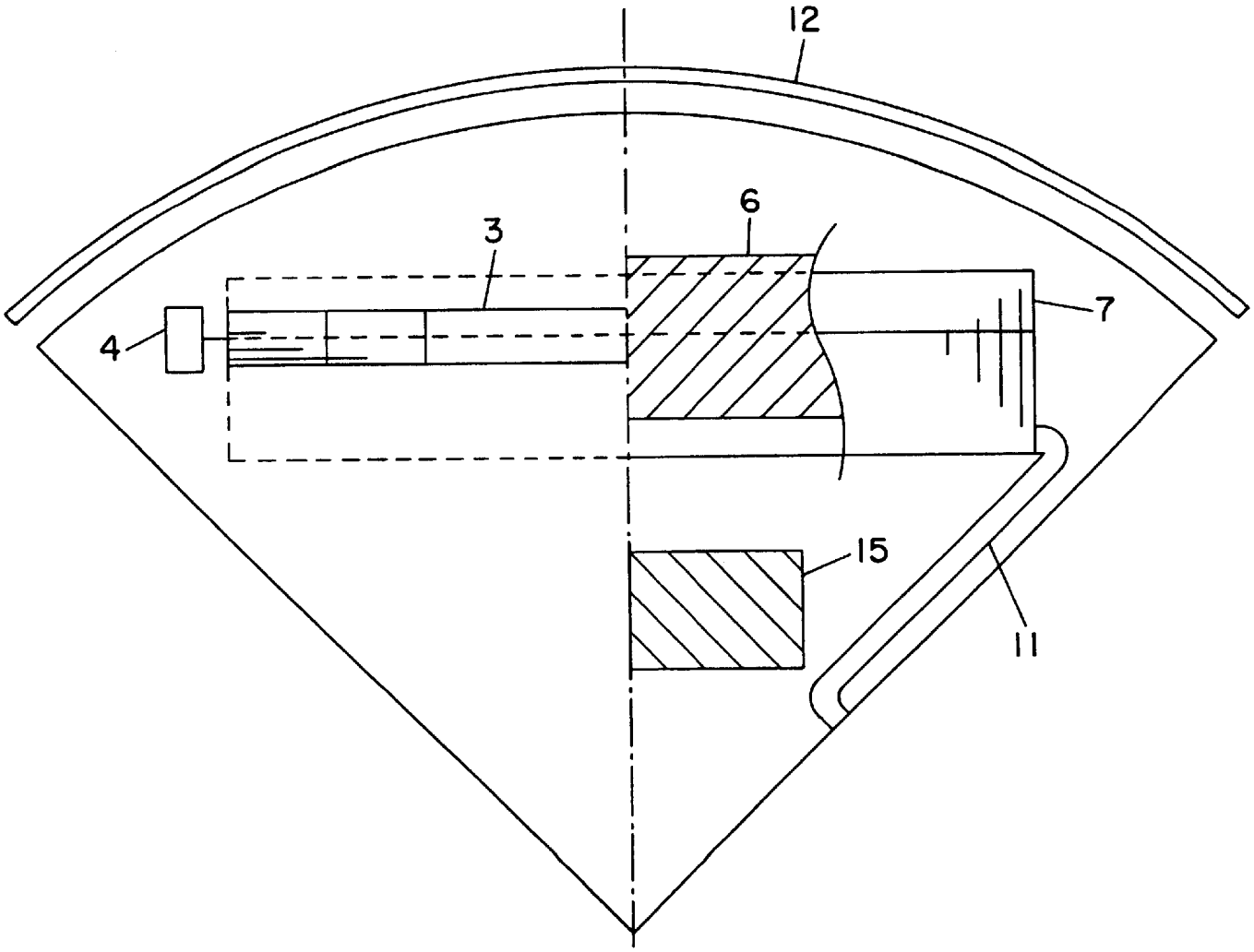
FIG. 27 is an essential plan of FIG. 19 as seen from the lower direction showing a thirteenth embodiment of the invention.
Figure 28:
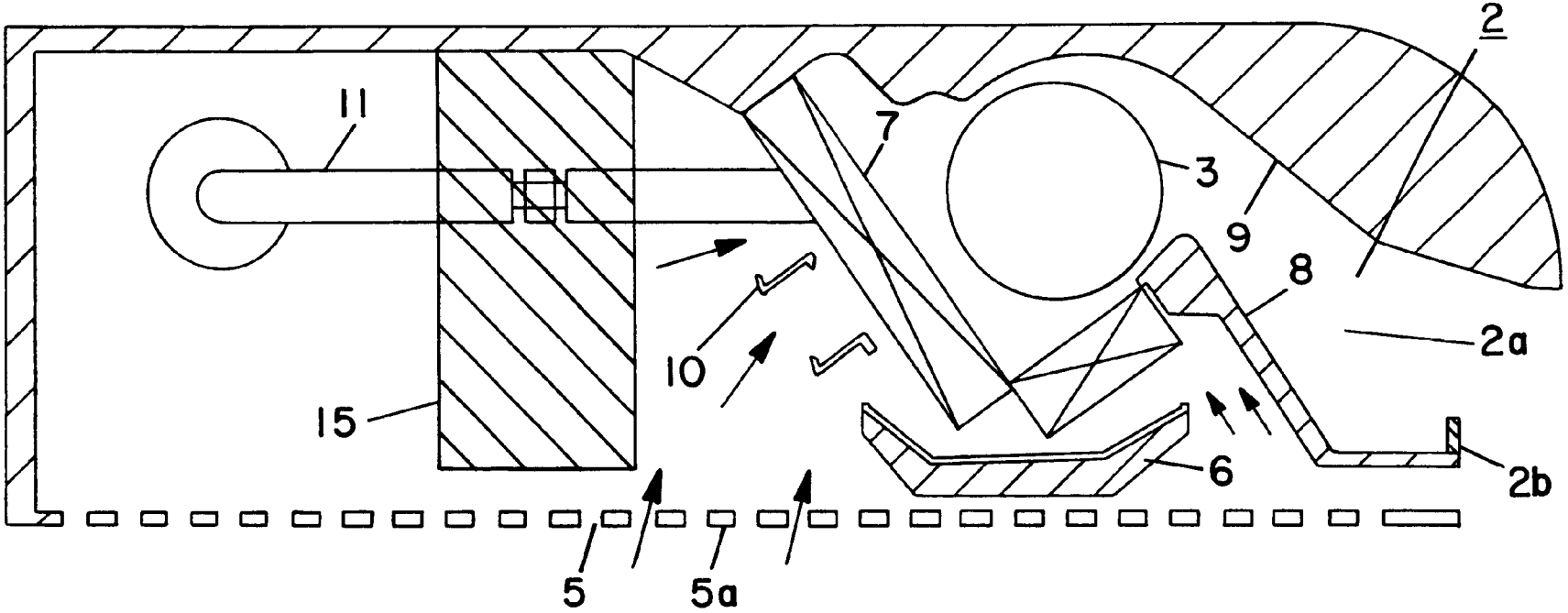
FIG. 28 is a sectional view along line 206—206 in FIG. 20 showing a fourteenth embodiment of the invention.

A different embodiment of the invention is described in FIG. 27 and FIG. 28. FIG. 27 is an essential plane sectional view of FIG. 22 as seen from the lower direction. Same constituent elements as shown in FIG. 21 are identified with same reference numerals, and their description is omitted. In the space between a grille 5 and a heat exchanger 7, an electrical part 15 is placed. FIG. 28 is a sectional view along line 206—206 in FIG. 20, and the electrical part 15 are placed away from the heat exchanger 7, and the effect of air suction on the heat exchanger 7 is kept to a minimum extent. As the electrical part is disposed at this position, the space can be utilized effectively. Moreover, the electrical part is cooled. The conventional electrical part can be used as a common part, and the cost is saved.

Exemplary Embodiment 14

Figure 29:
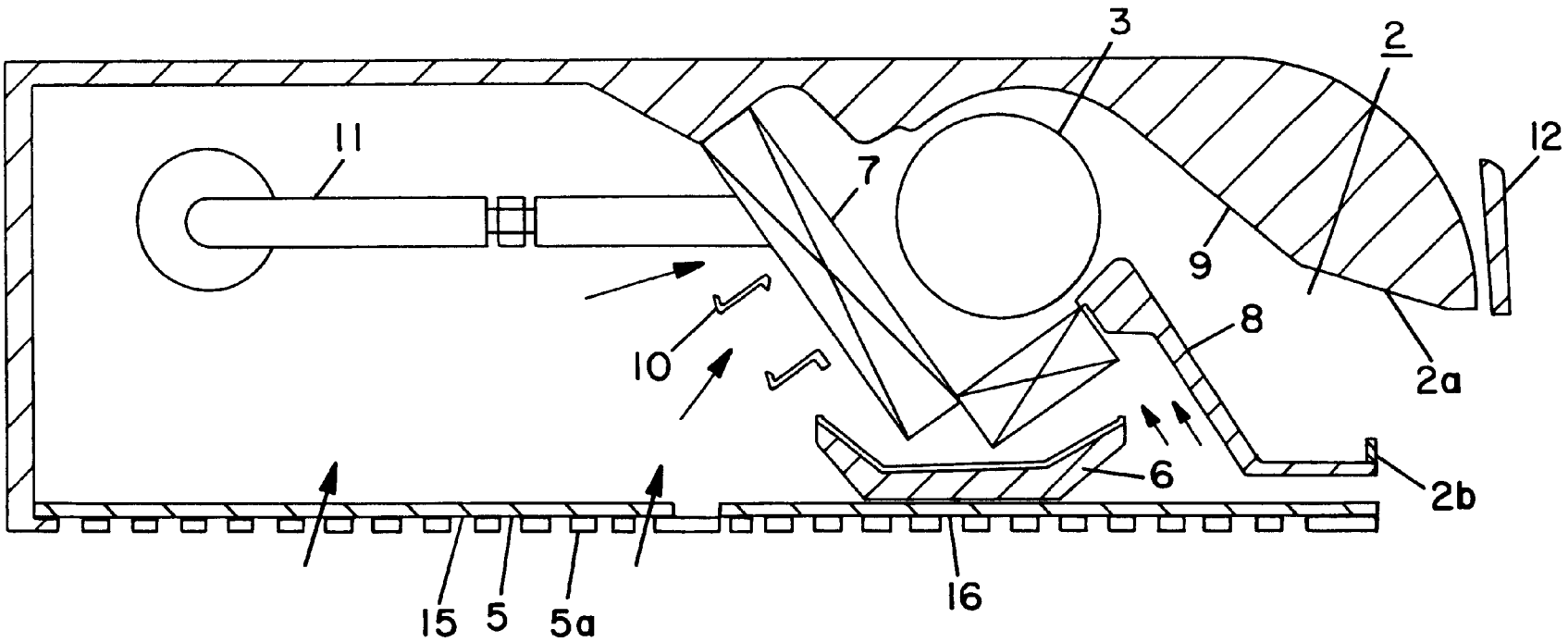
FIG. 29 is a sectional view along line 206—206 in FIG. 20 showing a fifteenth embodiment of the invention.

A different embodiment of the invention is described in FIG. 29. FIG. 29 is a sectional view along line 206—206 in FIG. 20. Same constituent elements as shown in FIG. 21 are identified with same reference numerals, and their description is omitted. A filter 16 is placed horizontally between a grille 5 placed at a lower position as a suction port and a water pan 6 for handling the condensate of a heat exchanger 7. The filter 16 is divided into two parts, so that it can be removed easily when cleaning. By this filter 16, the room dust can be removed easily. Moreover, by dismounting the grille only, the internal connection piping work and drain work are easy, and the work is extremely facilitated.

Exemplary Embodiment 15

Figure 30:
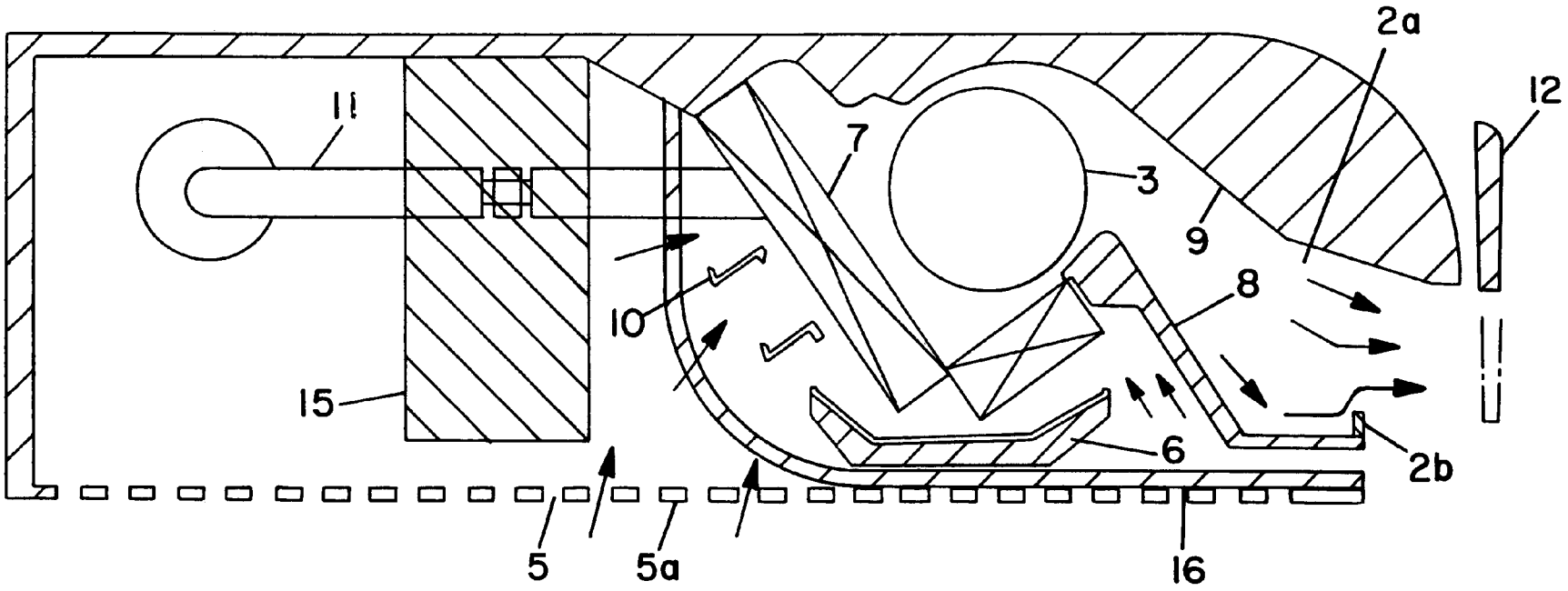
FIG. 30 is a sectional view along line 206—206 in FIG. 20 showing a sixteenth embodiment of the invention.

A different embodiment of the invention is described while referring to FIG. 30. FIG. 30 is a sectional view along line 206—206 in FIG. 20. Same constituent elements as shown in FIG. 21 are identified with same reference numerals, and their description is omitted. A filter 16 is placed in an L-shape between a grille 5 as a suction port disposed at a lower side and a water pan 6 for processing the condensate from a heat exchanger 7, and between an inclined tray for handling the condensate water of the heat exchanger 7 and an electrical part 15. The filter 16 is provided in a form for surrounding the circumference of the heat exchanger 7. Therefore, the dust getting in from the piping hole or tiny clearance in the air conditioner main body 1 can be cleaned thoroughly. Besides, by detaching only the grille, the piping connection work, drain work and other work are easy.

This filter 16 may be also composed of a plurality of filters.

Exemplary Embodiment 16

Figure 31:
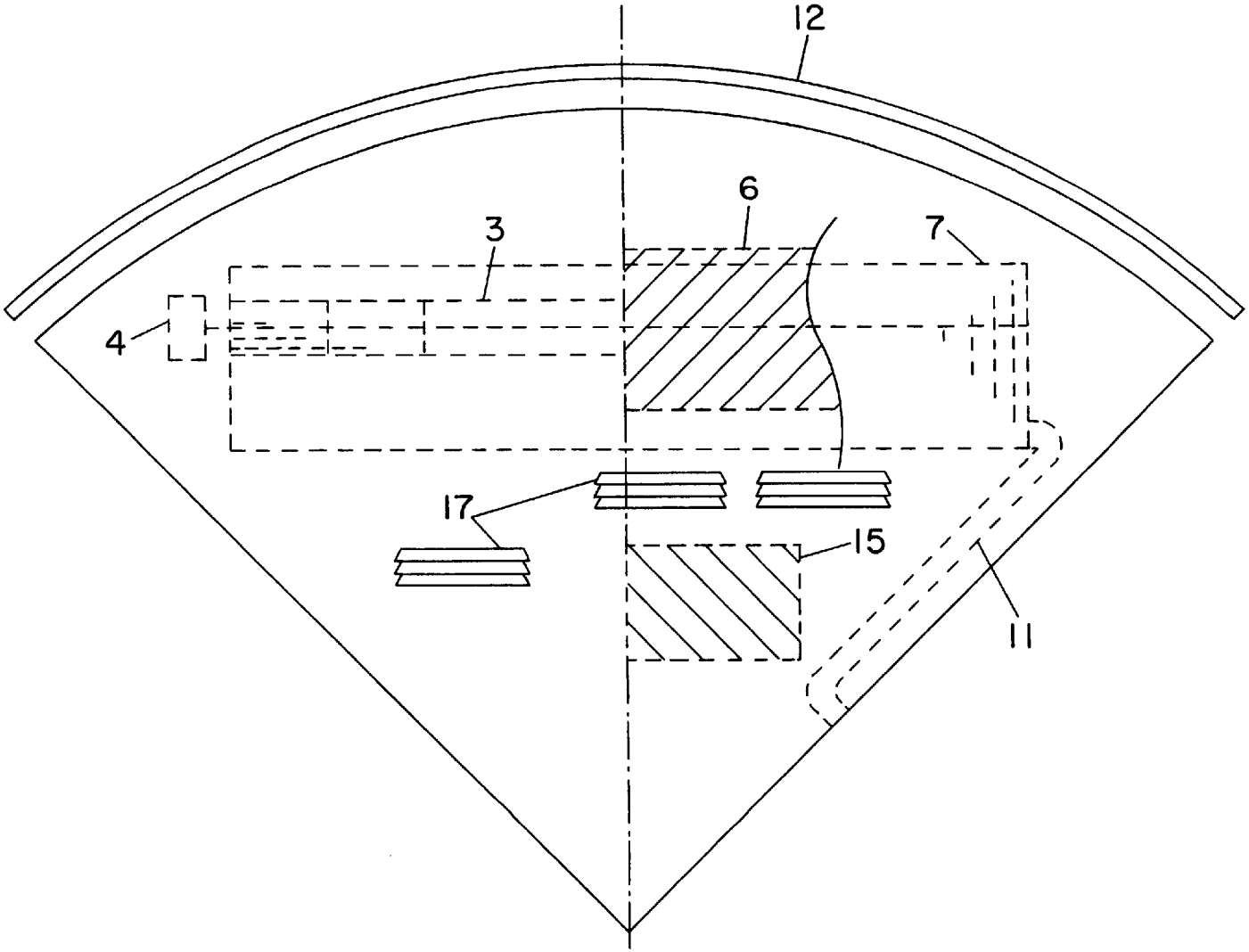
FIG. 31 is a plan of FIG. 19 as seen from the ceiling side showing a seventeenth embodiment of the invention.

A different embodiment of the invention is described while referring to FIG. 31. FIG. 31 is a plan of FIG. 19 as seen from the ceiling side. A louver 17 is placed in the upper side portion of the air conditioner main body 1. On an internal connection piping 18 at the upstream side of an air flow of a heat exchanger 7 and on an accommodating compartment of an electrical part 15, a plurality of louvers 17 are placed. In this constitution, the suction volume of air entering from the gaps increases, and the air blowing performance is enhanced.

Exemplary Embodiment 17

A leading end bump 2*b* of an arbitrary height provided at the leading end of a horizontal portion 2H of the lower side of a horizontal air diffuser 2*a* is formed of a water absorbing material such as a non-woven cloth having water absorbing property or water retaining property. In this constitution, the dew condensation water depositing around the air diffuser at high load is absorbed by the leading end bump 2*b*, so that dropping of water into the room is prevented.

As described herein, the invention brings about the following effects.

The wind coming out of the air conditioner reaches the whole parts of the room. The temperature in the room is uniformly controlled, and the comfort is enhanced. The air blowing performance is improved. The noise level is low. The appearance is excellent. Generation of unusual sound is suppressed at high load. The cost is saved. The installation work is easy when installing the air conditioner. The air conditioning performance is improved. The air conditioner main body is extremely compact. The air is blown out at a wide angle, and the comfort for the user is enhanced. The appearance (outlook) is improved. The wind direction changing range is wide. Dropping of dew condensation water into the room is prevented.

What is claimed is:

1. An air conditioner comprising:

a grille for receiving air, a heat exchanger for exchanging heat of said air, and a blower for blowing said heat exchanged air out of said air conditioner through an air diffuser, wherein the heat exchanged air is blown out of the air diffuser more downwardly at ends thereof than at a center point thereof.

2. An air conditioner of claim 1, wherein said air diffuser has such a shape that an outer circumference of the section in the horizontal direction has a nearly arc shape.

3. An air conditioner of claim 1, further comprising a passage placed between said blower and said air diffuser, wherein said wind is blown out through said passage and said air diffuser.

4. An air conditioner of claim 1, wherein said air diffuser has a passage composed a stabilizer and a rear guider, and said wind is controlled in the blow-out direction by the shape of said stabilizer and rear guider in said passage, and is blown out from said air diffuser.

5. An air conditioner of claim 1, wherein said blower has a cross flow fan.

6. An air conditioner of claim 1, wherein the section in the horizontal direction has a nearly sector shape.

7. An air conditioner of claim 1, wherein the section in the horizontal direction has a quarter divided shape of at least one shape selected from the group consisting of square, rectangle, circle and ellipse.

8. An air conditioner of claim 1, wherein said air diffuser has a passage composed a stabilizer and a rear guider, said stabilizer has a horizontal plane near the outlet of said air diffuser, and the region of said horizontal plane retreats to the back side of the air diffuser as going from the center of said air diffuser toward the both ends, thereby blowing out said wind blown out from said both ends in said horizontal direction in the lower direction than the direction of said wind blown out from said center of said horizontal direction.

9. An air conditioner of claim 1, wherein said air diffuser has a passage composed a stabilizer and a rear guider, said stabilizer has a horizontal plane near the outlet of said air diffuser, and the length of said horizontal plane becomes shorter as going from the center of said air diffuser toward the both ends, thereby blowing out said wind blown out from said both ends in said horizontal direction in the lower direction than the direction of said wind blown out from said center of said horizontal direction.

10. An air conditioner of claim 1, wherein said air diffuser has such a shape that the inclination is changed downward as going from the center in the horizontal direction toward the both ends, thereby blowing out said wind blown out from said both ends in said horizontal direction in the lower direction than the direction of said wind blown out from said center of said horizontal direction.

11. An air conditioner of claim 1, wherein said air diffuser has a wind direction changer placed at the opening of said air diffuser so as to be movable vertically, thereby controlling the direction of said wind as said wind direction changer moves vertically.

12. An air conditioner of claim 11, wherein said wind direction changer is placed outside of said air diffuser.

13. An air conditioner of claim 11, wherein said wind direction changer is placed to cover said air diffuser, and has a shape along the outer circumference of said air diffuser.

14. An air conditioner of claim 1, wherein said air diffuser has a passage composed of a stabilizer and a rear guider, and said rear guider has a first bump formed at a position where the distance between said blower and said rear guide may be the shortest, and a second bump formed at the upstream side of the air flow of said first bump.

15. An air conditioner of claim 14, wherein said second bump has a larger shape at both ends than at the center in the horizontal direction of said suction port.

16. An air conditioner of claim 14, wherein the shortest distance between said second bump and said blower is longer than the shortest distance between said first bump and said blower.

17. An air conditioner of claim 1, further comprising an electrical part placed between said suction port and said heat exchanger.

18. An air conditioner of claim 1, further comprising a water pan placed in the lower direction of said heat exchanger.

19. An air conditioner of claim 1, further comprising a water pan placed in the lower direction of said heat exchanger, and a filter placed between said suction port and said water pan.

20. An air conditioner of claim 1, further comprising a filter placed between said suction port and said heat exchanger.

21. An air conditioner of claim 20, wherein said filter is placed to cover said heat exchanger, and has a section of a nearly L-shape.

22. An air conditioner of claim 1, wherein said grille is placed at the front side.

23. An air conditioner of claim 1, wherein said grille is placed at the lower side.

24. An air conditioner of claim 1, further comprising a louver placed at the upper side.

25. An air conditioner of claim 1, wherein said blower has a plurality of cross flow fans coupled through a universal joint, and said plurality of cross flow fans are placed along the opening of said air diffuser.

26. An air conditioner of claim 1, further comprising a water absorbing member placed in said air diffuser.

27. An air conditioner of claim 1, wherein said air diffuser has a passage composed of a stabilizer and a rear guider, said stabilizer is placed at the lower side of said passage, and said stabilizer has a leading end bump formed at the leading end at the outlet of said air diffuser, near the center in the horizontal direction of said air diffuser.

28. An air conditioner of claim 27, wherein said leading end bump has an action for blowing out said wind blown out from said center in a further horizontal direction.

29. An air conditioner of claim 27, wherein said leading end bump is composed of a water absorbing member.

30. An air conditioner of claim 1, wherein said air diffuser has a passage composed of a stabilizer and a rear guider, said stabilizer is placed at the lower side of said passage, and said stabilizer has a straightening plate extended nearly in the horizontal direction, placed at the leading end of the outlet of both ends in the horizontal direction of said air diffuser.

31. An air conditioner of claim 30, wherein said straightening plate has an action of blowing out said wind blown out from said both ends in a slightly horizontal direction than the lower direction.

32. An air conditioner of claim 1, wherein said air diffuser has a passage composed of a stabilizer and a rear guider, said stabilizer is p laced at the lower side of said passage, said stabilizer has a leading end bump formed at the leading end at the outlet of said air diffuser, at the center in the horizontal direction of said air diffuser, and said stabilizer has a straightening plate extended nearly in the horizontal direction, p lac ed at the leading end of the outlet of said air diffuser, at both ends of said air diffuser.

33. An air conditioner of claim 32, wherein said leading end bump has an action for blowing out said wind blown out from said center in a further horizontal direction, and said straightening plate has an action of blowing out said wind blown out from said both ends in a slightly horizontal direction than the lower direction.

34. An air conditioner of claim 32, having a nearly sector shape so as to be installed at a corner of two adjacent walls.

35. An air conditioner of claim 1, having a nearly sector shape so as to be installed at a corner of two adjacent walls.

36. An air conditioner of claim 32, wherein said air diffuser has a shape having an outer circumference of a nearly arc shape on the section in the horizontal direction, so as to be installed at a corner of two adjacent walls.

37. An air conditioner of claim 1, wherein said air diffuser has a shape having an outer circumference of a nearly arc shape on the section in the horizontal direction, so as to be installed at a corner of two adjacent walls.

38. An air conditioner of claim 1, wherein said air diffuser has a shape having an outer circumference of a nearly arc shape on the section in the horizontal direction, and the back side of said air diffuser is mounted on the wall.

39. An air conditioner of claim 1, wherein the section in the horizontal direction has a quarter divided shape of at least one shape selected from the group consisting of square, rectangle, circle and ellipse, so as to be installed at a corner of mutually adjacent walls in a room, and said air diffuser is placed at a position in the direction toward the inner side of said room.

40. An air conditioner of claim 39, wherein said air diffuser has at least one shape of nearly arc shape and nearly linear shape.

* * * * *

UNITED STATES PATENT AND TRADEMARK OFFICE

CERTIFICATE OF CORRECTION

PATENT NO. : 6,141,983
DATED : November 7, 2000
INVENTOR(S) : Nishikawa et al.

It is certified that error appears in the above-identified patent and that said Letters Patent is hereby corrected as shown below:

Columns 1-16 should be deleted and substitute therefore columns 1-16, with the specification and claims as per attached.

Signed and Sealed this

Thirteenth Day of July, 2004

JON W. DUDAS
*Acting Director of the United States Patent and Trademark Office*

AIR CONDITIONER

FIELD OF THE INVENTION

The present invention relates to an air conditioner for cooling or heating the indoor air.

BACKGROUND OF THE INVENTION

Figure 32:
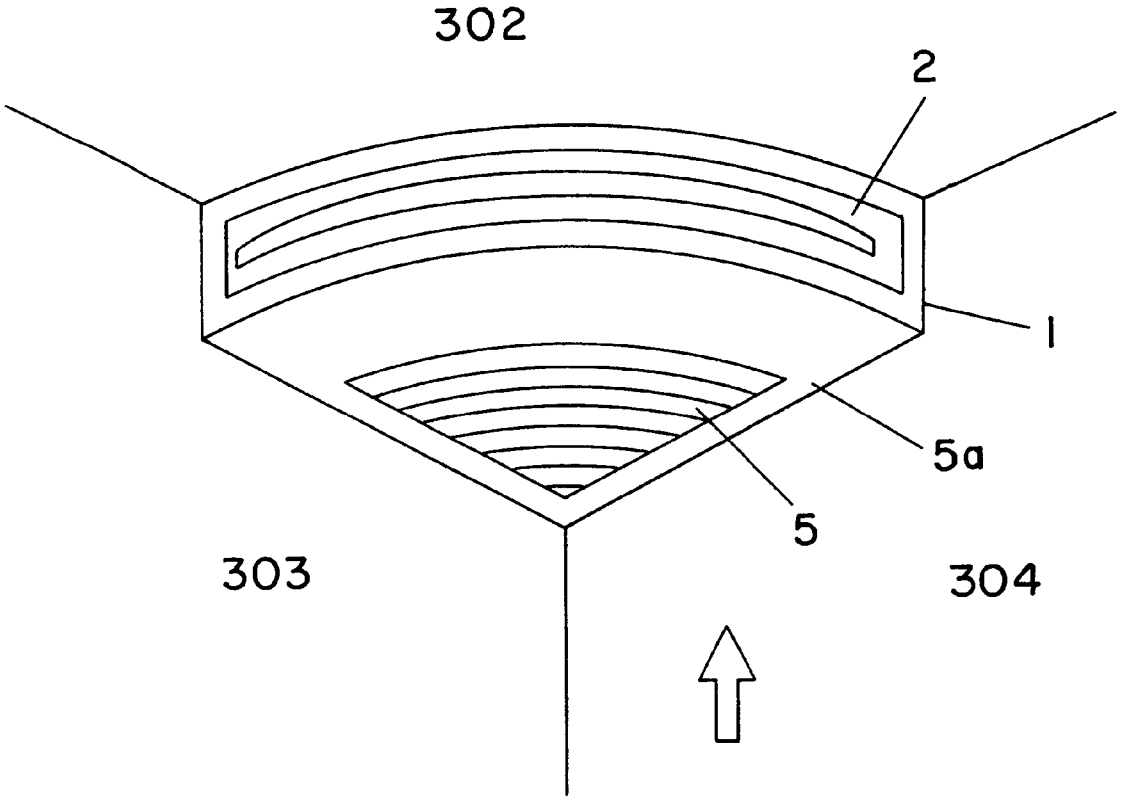
FIG. 32 PRIOR ART
FIG. 32 is a perspective view of an air conditioner in a prior art.
Figure 33:
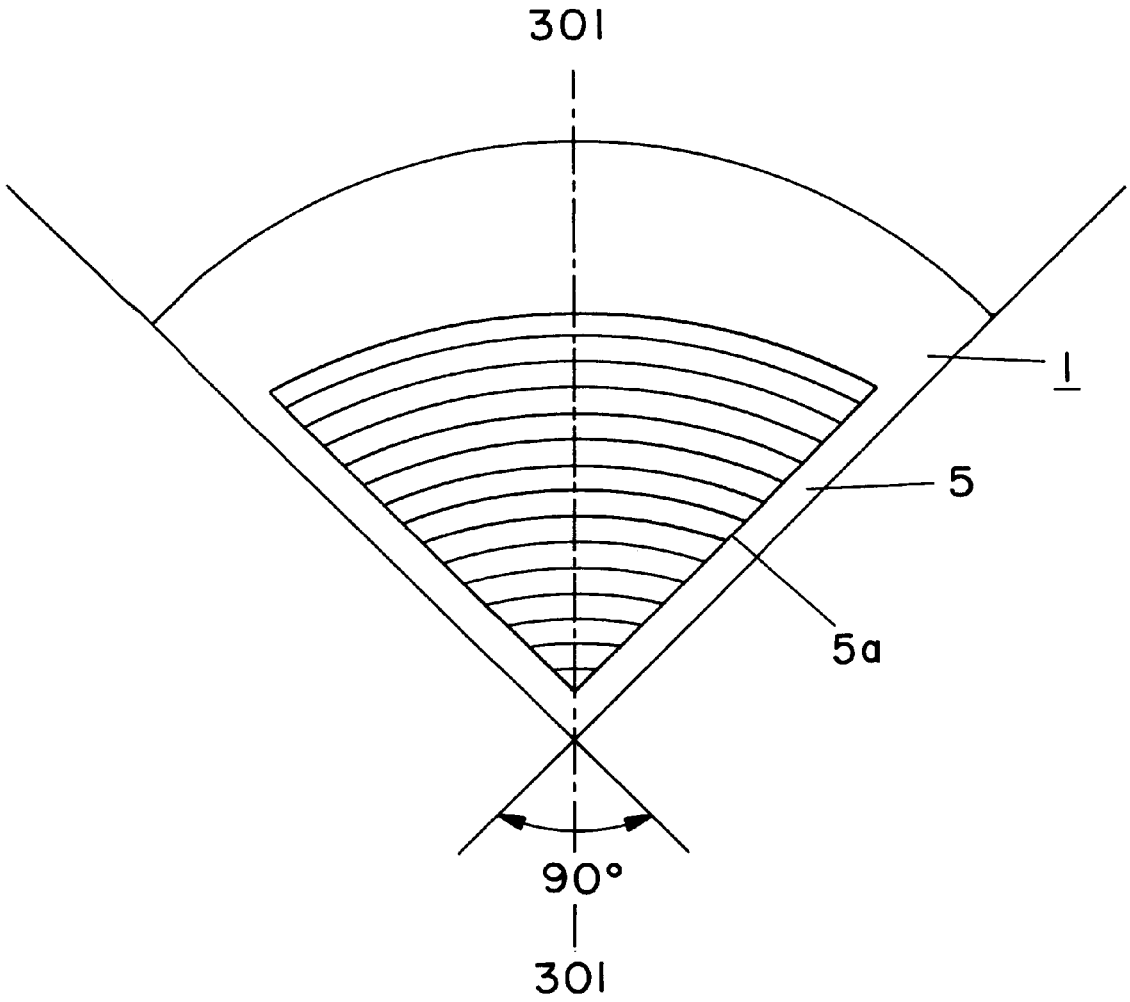
FIG. 33 PRIOR ART
FIG. 33 is a plan of FIG. 32 as seen from the lower direction.
Figure 34:
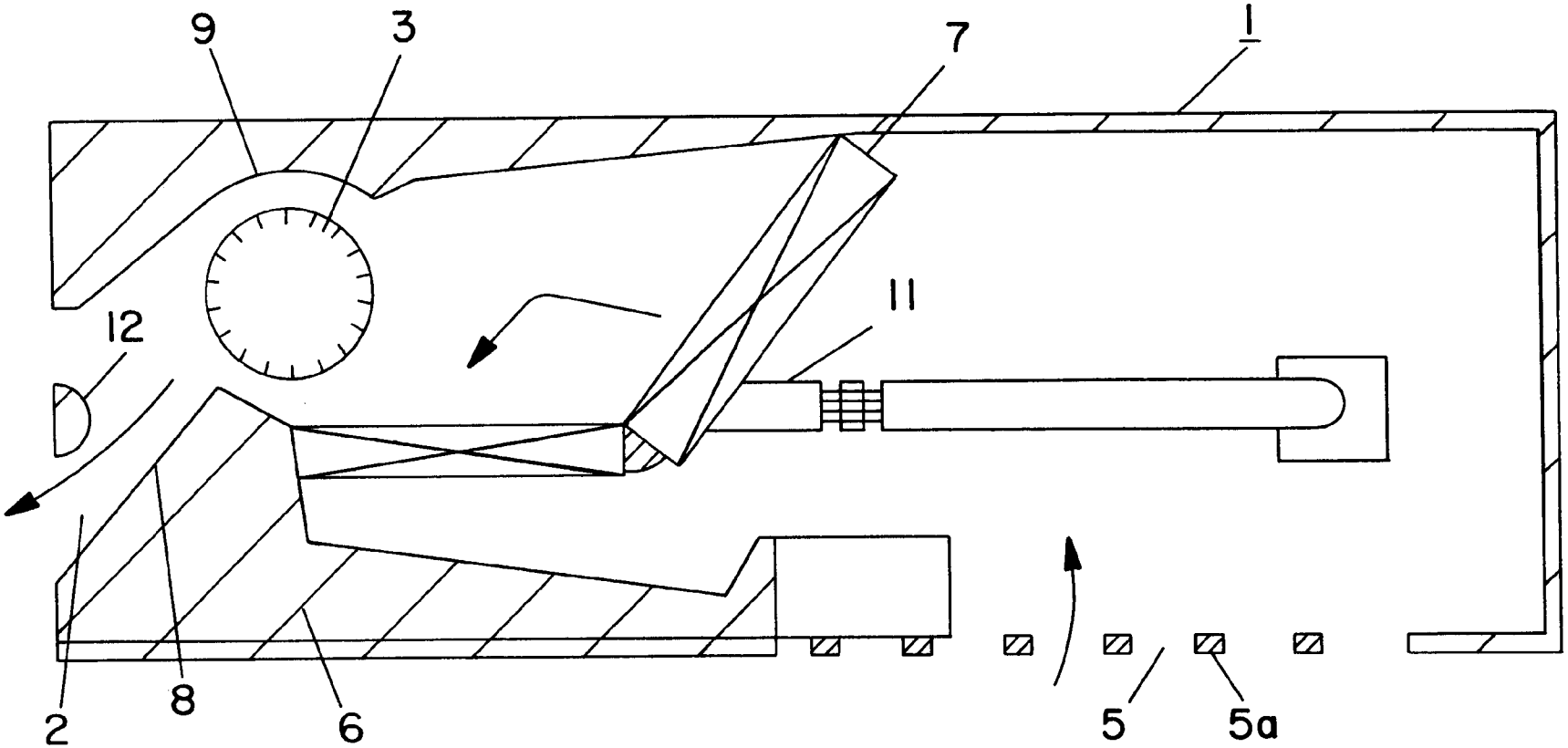
FIG. 34 PRIOR ART
FIG. 34 is a sectional view along line 301—301 in FIG. 33.
Figure 35:
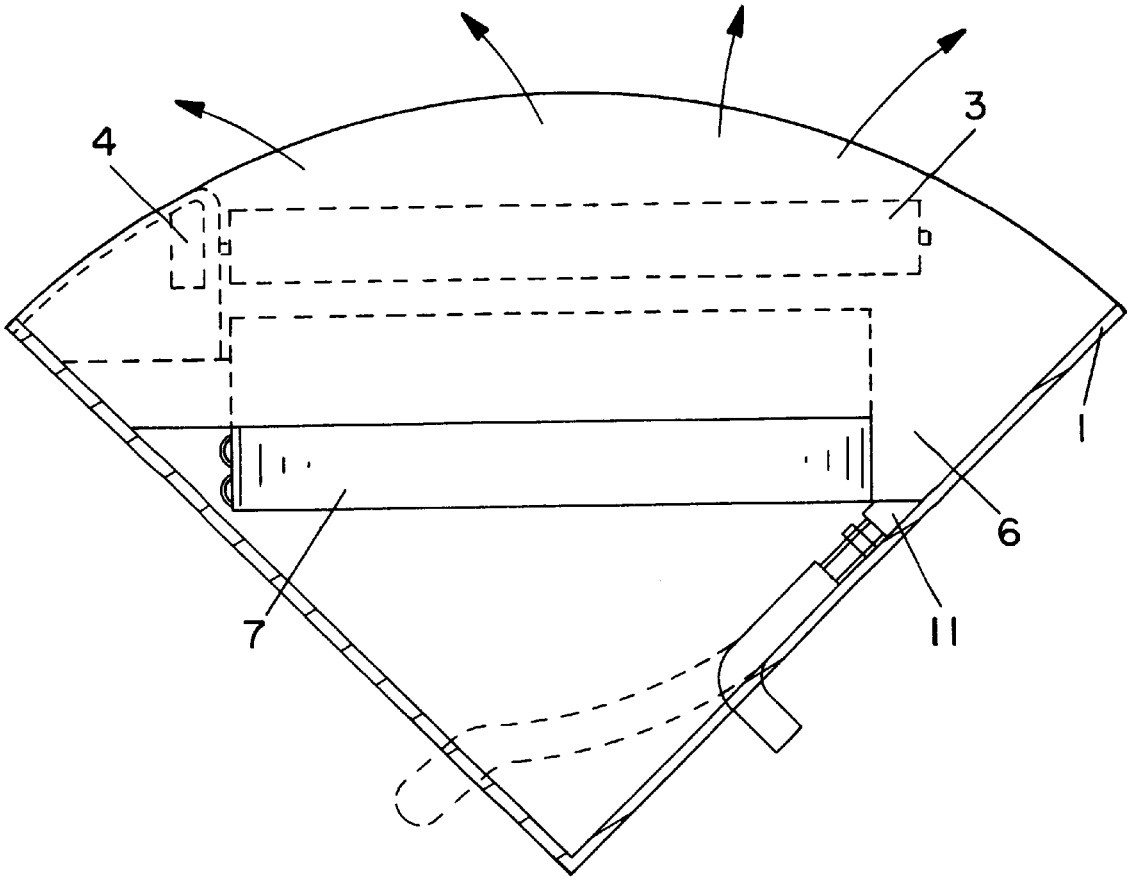
FIG. 35 PRIOR ART
FIG. 35 is an essential sectional view of FIG. 34 as seen from the lower direction.

A conventional air conditioner is composed as shown in FIG. 32 to FIG. 36 as disclosed, for example, in Japanese Laid-open Patent No. 9-166353. FIG. 32 is a perspective view of installation of an air conditioner in a room, and FIG. 33 is a plan view seen from the lower direction of FIG. 32. FIG. 34 is a sectional view along line 301—301 in FIG. 33, and FIG. 35 is an essential sectional view as seen from the lower direction of FIG. 34. FIG. 36 is a plane temperature distribution profile in air heating operation when the air conditioner main body is installed at a corner of a room.

An air conditioner main body 1 is installed closely to a corner of a ceiling 302 of a room and walls 303, 304 in two directions, and has a sector shape of a quarter arc, having a suction port at the lower side, and an air diffuser 2 in the arc part. While a cross flow fan 3 is rotated by a drive unit 4, air is sucked in from a front grille 5 having a suction port in the lower part, and heat is exchanged through a heat exchanger 7 provided above a water pan 6, and air flows into the arc-shaped air diffuser 2 composed of a stabilizer 8 and a rear guider 9. Thus, air blow action is achieved. Inside the air conditioner main body 1, an internal connection piping 11 is installed, and a wind direction changer 12 is attached to the air diffuser 2. Since the air diffuser 2 is arc-shaped, the distance is different at both ends of the cross flow fan 3 and air diffuser 2.

Such conventional air conditioner, however, has the following problems.

Since the air diffuser 2 is shaped to have a quarter arc, at both ends of the air diffuser 2, the length of the stabilizer 8 and rear guider 9 for composing the air diffuser 2 is extremely short, and the distance between the cross flow fan 3 and air diffuser 2 is close, and noise is likely to occur.

In FIG. 34, moreover, in the case the stabilizer 8 and rear guider 9 are inclined downward, as approaching from the center of the arc shape toward the both ends, the air diffuser 2 is scraped off upward. Accordingly, the appearance is impaired, and the comfort of air heating is worsened.

Besides, the water pan 6 is located at a position of clogging the suction port 5 near the cross flow fan 3, and the water pan 6 works as resistance to air blow, and therefore at high load, an unusual buzzing sound is likely to occur due to rotation of the cross flow fan 3.

Moreover, the air conditioner main body 1 is installed closely at the corner of the room ceiling 302 and walls 303, 304, the suction port is installed at the lower side, and the air diffuser 2 is installed at the front side. Accordingly, the suction region is limited, and the wall Coanda effect (the effect of the wind flowing along the wall) takes place. As a result, the blown air is pulled in the lower direction, and the wind is not directed in the horizontal direction when cooling the air. Furthermore, due to short circuit, the air conditioning capability is lowered. It is more likely to condense dew. When heating, the hot air reaches only near the air conditioner main body, and the temperature distribution in the room is not uniform, and the comfort is spoiled. When the air conditioner main body 1 is placed at a corner of a room, the temperature distribution in heating operation is shown in FIG. 36.

The invention is therefore intended to improve the noise performance, comfort and appearance, and further enhance the comfort by decreasing the temperature difference in the room, and prevent occurrence of unusual sound.

SUMMARY OF THE INVENTION

The air conditioner of the invention comprises:

a grille for sucking air, a heat exchanger for exchanging heat with the air, a blower for feeding the air exchanged of heat by the heat exchanger, and an air diffuser for blowing out the wind generated by the blower, in which the air diffuser has such a shape that the direction of the wind blown out from both ends in a horizontal direction may be the lower direction than the direction of the wind blown out from the center in the horizontal direction.

Preferably, the air diffuser has such a shape that the outer circumference of the section in the horizontal direction has a nearly arc shape.

Preferably, the section in the horizontal direction has a nearly sector shape.

Preferably, the air conditioner can be installed at a corner of the ceiling of a room and mutually adjacent walls.

Preferably, the air diffuser has a passage composed a stabilizer and a rear guider, and the wind is controlled in the blow-out condition by the shape of the stabilizer and rear guider in the passage, and is blown out from the air diffuser.

Preferably, the stabilizer and rear guider have a horizontal plane near the outlet of the air diffuser, and the region of the horizontal plane retreats to the back side of the air diffuser as going from the center of the air diffuser toward both ends.

Preferably, the stabilizer and rear guider have a horizontal plane near the outlet of the air diffuser, and the length of the horizontal plane becomes shorter as going from the center of the air diffuser toward both ends.

Preferably, the air diffuser has such a shape that the inclination is changed downward as going from the center in the horizontal direction toward both ends.

Preferably, the air diffuser has a wind direction changer placed at the opening of the air diffuser so as to be movable vertically.

Preferably, the stabilizer is placed at the lower side of the passage, and the stabilizer has a leading end bump formed at the leading end at the outlet of the air diffuser, at the center in the horizontal direction of the air diffuser.

Preferably, the stabilizer is placed at the lower side of the passage, and the stabilizer has a straightening plate extended nearly in the horizontal direction, placed at the leading end of the outlet of the air diffuser.

BRIEF DESCRIPTION OF THE DRAWINGS

FIG. 1 is a perspective view of an air conditioner showing an embodiment of the invention.

FIG. 2 is a sectional view along line 201—201 in FIG. 1.

FIG. 3 is a sectional view along line 202—202 in FIG. 1.

FIG. 4 is a perspective view of an air conditioner showing a second embodiment of the invention.

FIG. 5 is an outline plan of FIG. 4 as seen from the lower direction.

FIG. 6 is a sectional view along line 204—204 in FIG. 5.

FIG. 7 is a sectional view along line 205—205 in FIG. 5.

FIG. 8 is a horizontal sectional outline view of other example of a sector shape of the invention.

FIG. 9 is a diagram showing an air blow-out direction in FIG. 6.

FIG. 10 is a plane temperature distribution profile in air heating operation when the air conditioner of the invention is installed at a corner of a room.

FIG. 11 is a sectional view along line 204—204 in FIG. 5 showing a third embodiment of the invention.

FIG. 12 is a perspective sectional view along line 205—205 in FIG. 5 showing a fourth embodiment of the invention.

FIG. 13 is an essential plan of FIG. 4 as seen from the lower direction showing a fifth embodiment of the invention.

FIG. 14 is a sectional view along line 204—204 in FIG. 5 showing the fifth embodiment of the invention.

FIG. 15 is a sectional view along line 204—204 in FIG. 5 showing a sixth embodiment of the invention.

FIG. 16 is a sectional view along line 204—204 in FIG. 5 showing a seventh embodiment of the invention.

FIG. 17 is a plan of FIG. 4 as seen from the ceiling side showing an eighth embodiment of the invention.

FIG. 18 is an essential plane sectional view of FIG. 4 as seen from the lower direction showing a ninth embodiment of the invention.

FIG. 19 is a perspective view of an air conditioner showing a tenth embodiment of the invention.

FIG. 20 is a plane outline view of FIG. 19 as seen from the lower direction.

FIG. 21 is a sectional view along line 206—206 in FIG. 20.

FIG. 22 is a sectional view along line 207—207 in FIG. 20.

FIG. 23 is a horizontal sectional outline view of other example of a sector shape.

FIG. 24 is a plane temperature distribution profile in air heating operation when the air conditioner of the invention is installed at a corner of a room.

FIG. 25 is a sectional view along line 206—206 in FIG. 20 showing an eleventh embodiment of the invention.

FIG. 26 is a perspective view of a section along line 207—207 in FIG. 20 showing a twelfth embodiment of the invention.

FIG. 27 is an essential plan of FIG. 19 as seen from the lower direction showing a thirteenth embodiment of the invention.

FIG. 28 is a sectional view along line 206—206 in FIG. 20 showing a fourteenth embodiment of the invention.

FIG. 29 is a sectional view along line 206—206 in FIG. 20 showing a fifteenth embodiment of the invention.

FIG. 30 is a sectional view along line 206—206 in FIG. 20 showing a sixteenth embodiment of the invention.

FIG. 31 is a plan of FIG. 19 as seen from the ceiling side showing a seventeenth embodiment of the invention.

FIG. 32 is a perspective view of an air conditioner in a prior art.

FIG. 33 is a plan of FIG. 32 as seen from the lower direction.

FIG. 34 is a sectional view along line 301—301 in FIG. 33.

FIG. 35 is an essential sectional view of FIG. 34 as seen from the lower direction.

FIG. 36 is a plane temperature distribution profile in air heating operation when the air conditioner of the prior art is installed at a corner of a room.

REFERENCE NUMERALS

1 Air conditioner main body
2 Air diffuser
2*a* Horizontal air diffuser
2*b* Leading end bump at lower side of horizontal air diffuser
2*c* Lower air diffuser
2*e* Straightening plate
2*e* Center
2*f* Both ends
2*g* Passage
2H Horizontal lane
3 Cross flow fan
4 Drive unit
5 Grille
5*a* Lower suction port
6 Water pan
7 Heat exchanger
8 Stabilizer
9 Rear guider
10 Trough
11 Internal connection piping
12 Wind direction changer
13 First bump shortest in distance to cross flow fan
14 Second bump provided at upstream side of first bump 13
15 Electrical part
16 Filter
17 Louver
18 Universal joint

DETAILED DESCRIPTION OF THE INVENTION

An air conditioner of the invention is an indoor side blower unit having a heat exchanger and a cross flow fan provided in a housing, with the horizontal section of an air diffuser in a nearly arc shape, in which an air passage is formed of a stabilizer and a rear guider positioned adjacently and oppositely to the cross flow fan, and the air diffuser is provided in this passage so as to be directly nearly in the horizontal direction at the center in the longitudinal direction and inclined downward from the center at both ends. According to this constitution, the air flowing along near the wall is directed downward, while the air flowing toward the center of the room is directed in the horizontal direction, so that an air flowing field of smooth reaching is formed. Besides, an adequate distance is held between the cross flow fan and the air diffuser, so that generation of noise is prevented. Moreover, since the height of the air diffuser is kept constant, the appearance is preferable.

Other air conditioner of the invention is an indoor side blower unit having a heat exchanger and a cross flow fan provided in a housing, with the horizontal section in a nearly sector shape, in which an air passage is formed of a stabilizer and a rear guider positioned adjacently and oppositely to the cross flow fan, and an air diffuser is provided in this passage so as to be directly nearly in the horizontal direction at the center in the longitudinal direction and inclined downward from the center at both ends. According to this constitution, when installed at a corner of a room, the air flowing along near the wall is directed downward, while the air flowing toward the center of the room is directed in the horizontal direction, so that an air flow is likely to reach the entire room. Therefore, the comfort is improved. Besides, generation of noise is prevented. Moreover, since the height of the air diffuser is kept constant, the appearance is preferable.

Preferably, in a blower circuit having a water pan for handling the condensate of the heat exchanger provided at the downstream of the suction port, the rear guider has a first bump disposed at a position where the distance between the cross flow fan and the rear guider is the shortest, and a second bump disposed at the upstream side of the air flow of the first bump. In this constitution, if the air suction balance is broken by the water pan, the air suction amount flowing in the cross flow fan can be adjusted, and unusual buzzing sound generated at high load can be canceled.

Preferably, the rear guider has a first bump disposed at a position where the distance between the cross flow fan and the rear guider is the shortest, and a second bump disposed at the upstream side of the air flow of the first bump, and the end portion of the second bump is larger than the central portion in the longitudinal direction. In this constitution, the complicated flow of the end portion is improved, and generation of unusual buzzing sound from the end portion can be canceled.

Preferably, at the downstream side of the suction part, an electrical part is disposed in the blower circuit at the upstream side of the heat exchanger. In this constitution, the space can be effectively utilized. Moreover, the electrical part is cooled. Further, a conventional electrical part can be used as a common part, and the cost is saved.

Preferably, at the downstream side of the suction port, a filter is disposed at the upstream side of the water pan. In this constitution, the dust in the room can be treated easily. Besides, an economical filter shape can be employed, and the material cost is reduced.

Preferably, at the downstream side of the suction port, a filter is disposed in a nearly L-shape so as to cover the heat exchanger. In this constitution, the dust in the room can be treated easily, and in the piping connection work, drain work or other mounting work, the filter does not disturb, and it is easy to work.

Preferably, an opening for sucking air is disposed in the ceiling of the housing. In this constitution, the air suction volume increases, and generation of unusual buzzing sound at high load can be canceled.

A different air conditioner of the invention is an indoor side blower unit having a heat exchanger and a cross flow fan provided in a housing, with the horizontal section of an air diffuser in a nearly arc shape, in which a plurality of cross flow fans are coupled through a universal joint, and disposed along the air diffuser. According to this constitution, the length of the cross flow fan and area of the heat exchanger are increased, and the air conditioning performance is enhanced, and the air conditioner main body is formed in a more compact body. Moreover, since the air is blown out at a side angle from the air diffuser, the room temperature becomes uniform quickly, and the comfort is improved.

A further different air conditioner of the invention is an indoor side blower unit having a heat exchanger and a cross flow fan provided in a housing, with the horizontal section of an air diffuser in a nearly arc shape, in which a wind direction changer is disposed at an outer side to cover the air diffuser, and is moved up and down in the vertical direction to blow the air flow in upper and lower direction. According to this constitution, the wind direction changer covers the air diffuser at a specified position, and the opening of the air diffuser is hardly visible from the user in such configuration. As a result, the appearance is improved. Moreover, since the wind direction changer is moved up and down at the outer side of the air diffuser, the vertical moving range is wider, and the wind direction changing range is wider.

Other different air conditioner of the invention can be installed closely to a corner of the ceiling in a room and two walls. This air conditioner is an indoor side blower unit having a suction port at the lower side, and an air diffuser, a heat exchanger and a cross flow fan provided at the front side, with the section of the air diffuser in a horizontal direction in a nearly sector shape. The air diffuser has an air passage formed of a stabilizer and a rear guider positioned adjacently and oppositely to the cross flow fan. In this passage, the central portion of the suction port in the horizontal direction has a horizontal air diffuser directed nearly in a horizontal direction. At the leading end part of the lower side of the horizontal air diffuser, a leading end bump of an arbitrary height is formed. Further, both ends of the air diffuser have a downward air diffuser inclined downward from the central portion, and a straightening plate extended nearly in a horizontal direction, disposed at the leading end portion of the lower side of the downward air diffuser.

In this constitution, the wind hitting against the leading end bump generates a velocity vector in the horizontal direction, and the air flowing toward the center of the room is more likely to be directed in the horizontal direction. In the constitution including the horizontal air diffuser, downward air diffuser, and straightening plate, the air flowing along near the wall is directed from the lower direction to the horizontal direction, and the short-circuit due to wall Coanda effect can be prevented, and it is smooth to reach the entire room. As a result, a further comfort is obtained.

Preferably, the air conditioner has a water pan for handling the condensate disposed between the suction port and heat exchanger.

Preferably, along with the horizontal air diffuser, the constitution further includes a downward air diffuser inclined downward from the center at both ends of the air diffuser, and a straightening plate extended nearly in a horizontal direction at the lower side leading end portion of the downward air diffuser. In this constitution, the air flowing along near the wall is directed from the lower direction to the horizontal direction. Hence, it is smooth to reach the entire room. As a result, the comfort is improved. Besides, the distance between the cross flow fan and air diffuser is longer, and hence the noise is lowered.

Preferably, a bump of an arbitrary height disposed at the lower side leading end portion of the horizontal air diffuser is formed of a water absorbing material such as non-woven cloth having water absorbing property. In this constitution, the dew condensation water depositing around the air diffuser at high load is absorbed by this water absorbing material, and drop of dew condensation water into the room is prevented.

Referring now to the drawings, preferred exemplary embodiments of the invention are described in detail below.

Exemplary Embodiment 1

FIG. 1 is a perspective view of an air conditioner main body 1 in an embodiment of the invention being installed in a room. A sectional view along line 201—201 in FIG. 1 is shown in FIG. 2, and a sectional view along line 202—202 in FIG. 3. The air conditioner main body 1 comprises a heat exchanger 7, a cross flow fan 3 as a blower, a front grille 5 placed at the front side, and an air diffuser 2. The air diffuser 2 and the grille 5 have an arc outer shape at the section in the horizontal direction. The air diffuser 2 has a passage 2*g* composed of a stabilizer 8 and a rear guider 9. A wind direction changer 12 is disposed in the air diffuser 2. The stabilizer 8 also serves as a water pan for handling the condensate from the heat exchanger 7. The back side of the air conditioner main body 1 is provided at a wall 303 at a position near a ceiling 302. In this constitution, the central portion 2*e* in the horizontal direction of the air diffuser 2 is at a position of projecting into the central direction of the room, and both ends 2*f* of the air diffuser 2 are positioned near the wall 303 of the room.

While the cross flow fan 3 is rotating and blowing air, the room air is sucked in from the grille 5, and exchanged of heat through a plurality of heat exchangers 7, and flows into the air diffuser 2 of arc shape through the passage 2*g*. Thus, the heat exchanged air is sent into the room from the air diffuser 2.

The central portion 2*e* in the horizontal direction of the air diffuser 2 composed of the stabilizer 8 and rear guider 9 is shaped to be directed nearly in a horizontal direction, as shown in FIG. 2, so that the heat exchanged air may be blown out in a nearly horizontal direction as indicated by arrow. Further, both ends 2*f* in the horizontal direction of the air diffuser 2 are shaped to be directed in a lower direction than the central portion so that the heat exchanged wind may be blown out in a lower direction than the central portion as shown in FIG. 3. Between the central portion and the both ends, it is shaped so that the wind may be blown out gradually in the lower direction as going from the central portion to both ends. In this constitution, the wind flowing along near the room wall 303 is directed in the lower direction, while the wind flowing toward the room center is directed in the horizontal direction. That is, the heat exchanged air reaches the entire room three-dimensionally. Therefore, the heat exchanged wind reaches uniformly in every corner of the room, and the temperature of the entire room is uniform, and the comfort is enhanced notably.

Exemplary Embodiment 2

FIG. 4 is a perspective view of an air conditioner main body 1 in a second embodiment of the invention being installed in a room. FIG. 5 is a plan of FIG. 4 as seen from the lower direction. A sectional view along line 204—204 in FIG. 5 is shown in FIG. 6, and a sectional view along line 205—205 in FIG. 7.

The air conditioner main body 1 has a nearly sector shape at the section in the horizontal direction. The air conditioner main body 1 is installed closely to a corner of wall 303 and a wall 304 in the room. The air conditioner main body 1 may be also installed closely to a ceiling 302, or a space may be left between the air conditioner main body 1 and the ceiling 302. The air conditioner 1 comprises a grille 5 as a suction port disposed at the lower side, a heat exchanger 7, a cross flow fan 3 as a blower, and an air diffuser 2. The air diffuser 2 is positioned at a corner of the lower side and front side, and has an outer circumference of a quarter arc shape at the section in the horizontal direction. The air diffuser 2 has a passage 2*g* composed of a stabilizer 8 and a rear guider 9. In order that the height of the air diffuser 2 may be kept horizontal, the air conditioner main body 1 is mounted on the wall. In this state, while the cross flow fan 3 is rotating and blowing wind, the air is sucked in through the grille 5, and exchanged of heat through a plurality of heat exchangers 7, and is sent out from the arc air diffuser 2. Thus, the air conditioner 1 has a blowing action.

The air conditioner main body 1 further comprises a water pan 6 for handling the condensate from the heat exchanger, a tray 10 for handling the condensate from the heat exchange in the slope area and guiding into the water pan 6, and an internal connection piping 11. A wind direction changer 12 is in such a size as to cover the air diffuser 2, and is disposed outside of the air diffuser 2, and is designed to be movable in the vertical direction.

In the air diffuser 2 composed of the stabilizer 8 and rear guider 9, the central portion 2*e* of the air diffuser 2 is composed so that the wind may be blown out in a nearly horizontal direction as shown in FIG. 6. Both ends 2*f* of the air diffuser 2 are composed so that the wind may be blown out in the lower direction as shown in FIG. 7. The air diffuser 2 is formed so that the wind being blown out may be gradually directed in the lower direction to change three-dimensionally, as going from the central portion 2*e* of the air diffuser 2 toward both ends 2*f* (section along line 205—205). In such constitution, the air flowing along near the wall is directed downward, and the air flowing toward the center of the room is directed in the horizontal direction. As a result, the heat exchanged air flow is likely to reach uniformly in the entire room, and hence the comfort is enhanced.

In FIG. 6, each one of the stabilizer 8 and rear guider 9 has a horizontal plane shape near the outlet of the air diffuser 2 (the region indicated by 2H). As going from the central portion 2*e* of the air diffuser 2 to both ends 2*f* (as approaching from the section of line 204—204 to the section of line 205—205), the region of the horizontal plane 2H in FIG. 6 retreats to the wall side. The length of the horizontal plane 2H becomes gradually shorter as going from the central portion 2*e* of the air diffuser 2 toward both ends 2*f*. Thus, by forming the air diffuser 2 controlled in the region of the horizontal plane and the length, the above effects are obtained.

Or, without forming the horizontal plane 2H of the air diffuser 2, the inclination of the air diffuser 2 may be gradually changed downward from the central portion 2*e* of the air diffuser 2 toward both ends 2*f* (from the section of line 204—204 to the section of line 205—205). That is, the inclinations of the stabilizer 8 and rear guider 9 for composing the air diffuser 2 are respectively controlled in a specified shape. In this constitution, as approaching both ends 2*f* from the central portion 2*e* of the air diffuser 2, the direction of the wind being blown out is gradually directed from the horizontal direction to the lower direction, and changes three-dimensionally. As a result, the same effects as above are obtained.

FIGS. 9 (*a*), (*b*), and (*c*) show the configuration of the air blow-out direction and the wind direction changer 12. FIG. 9 (*a*) shows the position of the wind direction changer 12 in operation stopped state (without air flow) and in air heating operation, in which the air is blown nearly in a straight downward direction. FIG. 9 (*c*) shows the position of the wind direction changer 12 in air cooling operation, in which air is blown out nearly in the horizontal direction. FIG. 9 (*b*) shows an intermediate position of FIG. 9 (*a*) and FIG. 9 (*c*), in which the air is blown out in an oblique lower direction. Thus, as the wind direction changer 12 moves up and down, the air blow-out direction can be changed nearly from the horizontal to the straight downward direction. When stopped, the since the air diffuser 2 is covered at its front, and the opening of the air diffuser 2 is not visible from the user, so that the appearance is improved. Moreover, since the wind direction changer 12 moves up and down outside of the air diffuser 2, the vertical moving range is wider, and the wind direction changing range is wider.

FIG. 10 shows the temperature distribution on the plane of the room in air heating operation by installing the air conditioner of the invention at a corner of a room. FIG. 36 shows the temperature distribution of a conventional air conditioner, in which the temperature is lower at near two walls to which the air conditioner is adjacent. By contrast, in FIG. 10 showing this embodiment, the temperature distribution when the air conditioner of the invention is installed, a uniform temperature distribution in the entire air is obtained, and the corners and the vicinity of the walls at the remotest positions from the air conditioner main body are warm, and the comfort is further enhanced.

As the sector shape of the section in the horizontal direction, it is possible to form in the modes as shown in FIGS. 8 (*a*), (*b*), (*c*) and (*d*). That is, the shape of the air conditioner main body has a quarter divided shape of at least one shape selected from the group consisting of square, rectangle, circle and ellipse. It is possible to installed at a corner of mutually adjacent walls of a room, and the air diffuser may be disposed at a position directed to the inner side of the room. The air diffuser has a nearly arc or a nearly linear shape.

Exemplary Embodiment 3

A third embodiment of the invention is described while referring to FIG. 11. FIG. 11 is a sectional view along line 204—204 of the central portion of the air conditioner in FIG. 5. In FIG. 11, same constituent elements as shown in FIG. 6 are identified with same reference numerals, and their description is omitted. A rear guider 9 forming a passage adjacently to as cross flow fan 3 has a first bump 13 located at the shortest distance between the cross fan 3 and rear guider 9, and a second bump 14 formed at the upstream side of the air flow of the first bump 13. The shortest distance between the second bump 14 and cross flow fan 3 is longer than the shortest distance of the first bump 13 and cross flow fan 3. In this constitution, the air suction volume flowing into the cross flow fan 3 is controlled. Therefore the balance of the air suction volume and discharge volume is even, so that generation of unusual sound at high load can be prevented.

Exemplary Embodiment 4

A fourth embodiment of the invention is described while referring to FIG. 12. FIG. 12 is a sectional view along line 205—205 of both ends of the air conditioner in FIG. 5. Same constituent elements as shown in FIG. 6 are identified with same reference numerals, and their description is omitted. The end portion of the second bump 14 is larger than in the central portion in the longitudinal direction of the passage. In this constitution, the complicated flow at the end portion is improved, and generation of unusual buzzing sound from the end portion is canceled.

The bulging of the end portion of the second bump 14 may be formed either at one side or at both sides.

Exemplary Embodiment 5

A fifth embodiment of the invention is described while referring to FIG. 13 and FIG. 14. FIG. 13 is an essential plane sectional view of FIG. 4 as seen from the lower direction. Same constituent elements as shown in FIG. 6 are identified with same reference numerals, and their description is omitted. An electrical part 15 is installed in the space between the downstream side of the grille 5 and the upstream side of the heat exchanger 7. FIG. 14 shows a sectional view along line 204—204 in the central portion of FIG. 5, and the electrical part 15 is installed away from the heat exchanger 7, and the effect of the electrical part on the suction of air into the heat exchanger 7 is kept to a minimum limit. By positioning the electrical part 15 in this area, the space can be utilized effectively, and a compact air conditioner is obtained. Besides, the electrical part is cooled. Further, the conventional electrical part can be used as a common part, and the cost is saved.

Exemplary Embodiment 6

A sixth embodiment of the invention is described while referring to FIG. 15. FIG. 15 is a sectional view along line 204—204 in the central portion of FIG. 5. Same constituent elements as shown in FIG. 6 are identified with same reference numerals, and their description is omitted. A filter 16 is placed horizontally between a grille 5 as a suction port and a water pan 6 for processing the condensate from a heat exchanger 7. The filter 16 is divided into two parts, so that it can be removed easily when cleaning. By this filter 16, the room dust can be removed easily. Besides, an economical filter shape can be employed, and the material cost is saved.

Exemplary Embodiment 7

A seventh embodiment of the invention is described while referring to FIG. 16. FIG. 16 is a sectional view along line 204—204 in the central portion of FIG. 5. Same constituent elements as shown in FIG. 6 are identified with same reference numerals, and their description is omitted. A filter 16 is placed in an L-shape between a grille 5 as a suction port and a water pan 6 for processing the condensate from a heat exchanger 7, and between an inclined tray 10 for handling the condensate water of the heat exchanger 7 and an electrical part 15. The filter 16 is provided in a form for surrounding the circumference of the heat exchanger 7, so that the dust getting in from the piping hole or tiny clearance in the air conditioner main body 1 can be cleaned thoroughly. Besides, by detaching the grille, the piping connection work, drain work and other work are easy.

This filter 16 may be also composed of a plurality of filters.

Exemplary Embodiment 8

An eighth embodiment of the invention is described while referring to FIG. 17. FIG. 17 is a plan of FIG. 4 as seen from the ceiling side. A louver 17 is placed in the ceiling portion of the air conditioner main body 1. In an internal connection piping 11 at the upstream side of an air flow of a heat exchanger 7 and in the upper direction of an accommodating compartment of an electrical part 15, a plurality of louvers 17 are placed. In this constitution, the suction volume of air entering from the gaps increases, and the air conditioning performance and air blowing force are enhanced. Moreover, generation of unusual buzzing sound at high load can be canceled.

Exemplary Embodiment 9

A ninth embodiment of the invention is described while referring to FIG. 18. FIG. 18 is an essential plane sectional view of FIG. 4 as seen from the lower direction. Same constituent elements as shown in FIG. 6 are identified with same reference numerals, and their description is omitted. Two cross fans 3 are coupled through a universal joint 18, and are disposed in an arc form along an air diffuser 2. In this constitution, the length of the cross flow fans 3, and the area of the heat exchanger 7 are increased. Accordingly, the air conditioning performance is enhanced, and the air conditioner main body 1 is formed in a further compact body. Moreover, since the air is blown out at a wide angle from the air diffuser, the comfort is enhanced.

Incidentally, more than two cross flow fans 3 can be coupled, and in this constitution, too, the same effects as above are obtained.

Exemplary Embodiment 10

FIG. 19 is a perspective view of installation of an air conditioner in an embodiment of the invention in a room.

FIG. 20 is a plan of FIG. 19 as seen from the lower direction. FIG. 21 is a sectional view along line 206—206 in FIG. 20, and FIG. 22 is a sectional view along line 207—207.

An air conditioner main body 1 has a nearly sector shaped section in the horizontal direction. This air conditioner main body 1 is installed closely to a corner of a ceiling 302 in a room and two walls 303, 304. It has a suction port in the lower direction, and an air diffuser 2 in the arc shaped portion. While a cross flow fan 3 as a blower is rotating and blowing air, the air is sucked in from a grille 5 as a suction port 5a at the lower side, and is exchanged of heat through a plurality of heat exchangers 7, and flows into the arc shaped air diffuser 2. Thus, it has a blowing action. The air conditioner main body 1 incorporates a water pan 6 for handling the condensate of the heat exchangers, a tray 10 for handling the condensate of the heat exchanger 7 in the slope portion and guiding into the water pan 6, an internal connection piping 11, and a wind direction changer 12.

The air diffuser 2 has a passage composed of a stabilizer 8 and a rear guider 9. The air diffuser 2 comprises a horizontal air diffuser 2*a* directed nearly in a horizontal direction in the central portion in the horizontal direction, a leading end bump 2*b* having an arbitrary height placed at the leading end of a 2H portion at the lower side of the horizontal air diffuser 2*a*, a downward air diffuser 2*c* inclined downward from the central portion at both ends in the horizontal direction, and a straightening plate 2*d* extended nearly in a horizontal direction placed at the lower side leading end of the downward air diffuser 2*c*. The horizontal portion 2H in FIG. 21 has a nearly horizontal shape, and as approaching the section of line 207—207 at both sides from the section of line 206—206 in the central portion of the air diffuser 2, the horizontal portion 2H is positioned at a position gradually retreating to the wall side. As approaching the section of line 207—207 at both ends from line 206—206 in the central portion, the air diffuser 2 is gradually changed three-dimensionally so as to be directed in the lower direction. The height of the air diffuser 2 is held horizontally.

In the horizontal air diffuser 2*a* in the central portion of the air diffuser 2, the wind hitting against the leading end bump 2*b* has a velocity vector in the horizontal direction, and the air flowing toward the central portion of the room is more likely to be directed in the horizontal direction. At both ends of the air diffuser 2, by disposing the downward air diffuser 2*c* inclined downward from the central portion and the straightening plate 2*d* placed in the downward air diffuser 2*c*, short-circuit can be prevented by the wall Coanda effect. The air flowing along near the wall is blown from the lower direction to the range of the horizontal direction. In this constitution, the heat exchanged aid reaches the entire room. As a result, the temperature distribution in the room is uniform, and the comfort is notably enhanced.

The air conditioner main body having a nearly sector shape in the horizontal section may be also formed as shown in FIG. 23.

FIG. 24 shows the plane temperature distribution of the room in air heating operation by installing the air conditioner of the embodiment at a corner of the room. FIG. 36 shows the temperature distribution of a conventional air conditioner, in which the warm air does not reach the corners of the room, and the comfort is poor. By contrast, FIG. 24 shows the temperature distribution when the air conditioner of the embodiment is installed, in which a uniform temperature distribution is obtained, and the warm air reaches the corners of the room, and the comfort is notably enhanced.

Exemplary Embodiment 11

Other embodiment of the invention is described in FIG. 25. FIG. 25 is a sectional view along line 206—206 of the air conditioner in FIG. 20. Same constituent elements as shown in FIG. 21 are identified with same reference numerals, and their description is omitted. A rear guider 9 forms a passage adjacently a cross flow fan 3. The passage has a first bump 13 formed at a position where the distance between the cross flow fan 3 and the rear guider 9 is the shortest, and a second bump 14 formed at the upstream side of the air flow of the first bump 13. The distance between the second bump 14 and the cross flow fan 3 is longer than the distance between the first bump and the cross flow fan 3. In such constitution, the suction volume of the air flowing into the cross flow fan 3 is reduced. As a result, the air blowing performance is enhanced. Further, generation of unusual sound is suppressed.

Exemplary Embodiment 12

A different embodiment of the invention is described in FIG. 26.FIG. 26 is a sectional perspective view along line 207—207 of the air conditioner in FIG. 20. Same constituent elements as shown in FIG. 21 are identified with same reference numerals, and their description is omitted. Both ends of a second bump 14 have a shape larger than the central portion. In this constitution, the complicated flow in the end portion is improved, and the unusual buzzing sound generated from the end portion is canceled.

The bulging of the end portion of the bump 14 may be formed at either one side or both sides, and in this constitution the same effects as above are obtained.

Exemplary Embodiment 13

A different embodiment of the invention is described in FIG. 27 and FIG. 28. FIG. 27 is an essential plane sectional view of FIG. 22 as seen from the lower direction. Same constituent elements as shown in FIG. 21 are identified with same reference numerals, and their description is omitted. In the space between a grille 5 and a heat exchanger 7, an electrical part 15 is placed. FIG. 28 is a sectional view along line 206—206 in FIG. 20, and the electrical part 15 are placed away from the heat exchanger 7, and the effect of air suction on the heat exchanger 7 is kept to a minimum extent. As the electrical part is disposed at this position, the space can be utilized effectively. Moreover, the electrical part is cooled. The conventional electrical part can be used as a common part, and the cost is saved.

Exemplary Embodiment 14

A different embodiment of the invention is described in FIG. 29. FIG. 29 is a sectional view along line 206—206 in FIG. 20. Same constituent elements as shown in FIG. 21 are identified with same reference numerals, and their description is omitted. A filter 16 is placed horizontally between a grille 5 placed at a lower position as a suction port and a water pan 6 for handling the condensate of a heat exchanger 7. The filter 16 is divided into two parts, so that it can be removed easily when cleaning. By this filter 16, the room dust can be removed easily. Moreover, by dismounting the grille only, the internal connection piping work and drain work are easy, and the work is extremely facilitated.

Exemplary Embodiment 15

A different embodiment of the invention is described while referring to FIG. 30. FIG. 30 is a sectional view along line 206—206 in FIG. 20. Same constituent elements as shown in FIG. 21 are identified with same reference numerals, and their description is omitted. A filter 16 is placed in an L-shape between a grille 5 as a suction port disposed at a lower side and a water pan 6 for processing the condensate from a heat exchanger 7, and between an inclined tray 10 for handling the condensate water of the heat exchanger 7 and an electrical part 15. The filter 16 is provided in a form for surrounding the circumference of the heat exchanger 7. Therefore, the dust getting in from the piping hole or tiny clearance in the air conditioner main body 1 can be cleaned thoroughly. Besides, by detaching only the grille, the piping connection work, drain work and other work are easy.

This filter 16 may be also composed of a plurality of filters.

Exemplary Embodiment 16

A different embodiment of the invention is described while referring to FIG. 31. FIG. 31 is a plan of FIG. 19 as seen from the ceiling side. A louver 17 is placed in the upper side portion of the air conditioner main body 1. On an internal connection piping 18 at the upstream side of an air flow of a heat exchanger 7 and on an accommodating compartment of an electrical part 15, a plurality of louvers 17 are placed. In this constitution, the suction volume of air entering from the gaps increases, and the air blowing performance is enhanced.

Exemplary Embodiment 17

A leading end bump 2*b* of an arbitrary height provided at the leading end of a horizontal portion 2H of the lower side of a horizontal air diffuser 2*a* is formed of a water absorbing material such as a non-woven cloth having water absorbing property or water retaining property. In this constitution, the dew condensation water depositing around the air diffuser at high load is absorbed by the leading end bump 2*b*, so that dropping of water into the room is prevented.

As described herein, the invention brings about the following effects.

The wind coming out of the air conditioner reaches the whole parts of the room. The temperature in the room is uniformly controlled, and the comfort is enhanced. The air blowing performance is improved. The noise level is low. The appearance is excellent. Generation of unusual sound is suppressed at high load. The cost is saved. The installation work is easy when installing the air conditioner. The air conditioning performance is improved. The air conditioner main body is extremely compact. The air is blown out at a wide angle, and the comfort for the user is enhanced. The appearance (outlook) is improved. The wind direction changing range is wide. Dropping of dew condensation water into the room is prevented.

What is claimed is:

1. An air conditioner comprising:

a grille for receiving air, a heat exchanger for exchanging heat of said air, an air diffuser having a center portion and two ends, and a blower for blowing said heat exchanged air out of said air conditioner through said air diffuser, wherein the heat exchanged air is blown out of the air diffuser more downwardly at the ends thereof than at the center.

2. An air conditioner of claim 1, wherein said air diffuser extends outward from said air conditioner in a substantially arc shape.

3. An air conditioner of claim 1, further comprising a passage disposed between said blower and said air diffuser, wherein said heat exchanged air is blown out of the air conditioner through said passage and said air diffuser.

4. An air conditioner of claim 1, wherein said air diffuser has a passage comprising a stabilizer and a rear guider, wherein said stabilizer and said rear guider control direction to which said heat exchanged air is blown out of the air diffuser.

5. An air conditioner of claim 1, wherein said blower has a cross flow fan.

6. An air conditioner of claim 1, wherein said air conditioner, in a plane substantially perpendicular to a plane said air diffuser, has a substantially sector shape.

7. An air conditioner of claim 1, wherein said air conditioner, in a plane substantially perpendicular to a plane of said air diffuser, has a substantially sector shape, and wherein said air diffuser has a shape selected from the group consisting of a square, rectangle, circle and ellipse.

8. An air conditioner of claim 1, wherein said air diffuser has a passage comprising a stabilizer and a rear guider, said stabilizer has a horizontal plane near an outlet of said air diffuser, and wherein said horizontal plane extends rearwardly in the air diffuser from the center of said air diffuser toward both ends, so that said heat exchanged air is blown out of the air diffuser more downwardly at the ends thereof than at the center.

9. An air conditioner of claim 1, wherein said air diffuser has a passage comprising a stabilizer and a rear guider, said stabilizer in a horizontal plane near an outlet of said air diffuser becomes shorter in length extending from the center of said air diffuser toward the ends, so that said heat exchanged air blows out of the air diffuser more downwardly at the ends thereof than at the center.

10. An air conditioner of claim 1, wherein said air diffuser has an inclination more downward at ends thereof than at the center, so that said heat exchanged air is blown out of the air diffuser more downwardly at the ends thereof than at the center.

11. An air conditioner of claim 1, wherein said air diffuser has a heat exchanged air direction changer disposed at an opening of said air diffuser adopted to be movable vertically to control the direction of said heat exchanged air as said heat exchanged air direction changer moves vertically.

12. An air conditioner of claim 11, wherein said heat exchanged air direction changer is disposed outside of said air diffuser.

13. An air conditioner of claim 11, wherein said heat exchanged air direction changer extends between the ends of said air diffuser on an outer portion of said air conditioner.

14. An air conditioner of claim 1, wherein said air diffuser has a passage comprising a stabilizer and a rear guider, and said rear guider has a first bump formed at a position where a distance between said blower and said rear guider is shortest, and a second bump formed at an upstream side of the air flow of said first bump.

15. An air conditioner of claim 14, wherein said second bump has a larger shape at both ends than at the center in the horizontal direction of said grille.

16. An air conditioner of claim 14, wherein the shortest distance between said second bump and said blower is longer than the shortest distance between said first bump and said blower.

17. An air conditioner of claim 1, further comprising an electrical part disposed between said grille and said heat exchanger.

18. An air conditioner of claim 1, further comprising a water pan disposed between said grille and said heat exchanger.

19. An air conditioner of claim 1, further comprising a water pan disposed between said grille and said heat exchanger, and a filter disposed between said grille and said water pan.

20. An air conditioner of claim 1, further comprising a filter disposed between said grille and said heat exchanger.

21. An air conditioner of claim 20, wherein said filter is disposed on said heat exchanger and has a substantially L-shape.

22. An air conditioner of claim 1, wherein said grille is disposed at a front side of said air conditioner.

23. An air conditioner of claim 1, wherein said grille is disposed at a lower side of said air conditioner.

24. An air conditioner of claim 1, further comprising a louver disposed at an upper side of said air conditioner.

25. An air conditioner of claim 1, wherein said blower has a plurality of cross flow fans coupled through a universal joint, and said plurality of cross flow fans are disposed along an opening of said air diffuser.

26. An air conditioner of claim 1, further comprising a water absorbing member disposed in said air diffuser.

27. An air conditioner of claim 1, wherein said air diffuser has a passage comprising a stabilizer and a rear guider, said stabilizer is disposed at a lower side of said passage, and said stabilizer has a leading end bump formed at a leading end at an outlet of said air diffuser, near the center in the horizontal direction of said air diffuser.

28. An air conditioner of claim 27, wherein said leading end bump has a shape such that said heat exchanged air is blown out from said center in a further horizontal direction.

29. An air conditioner of claim 27, wherein said leading end bump comprises a water absorbing member.

30. An air conditioner of claim 1, wherein said air diffuser has a passage comprising a stabilizer and a rear guider, said stabilizer is disposed at a lower side of said passage, and said stabilizer has a straightening plate extending substantially in the horizontal direction, and disposed at a leading end of an outlet of both ends in the horizontal direction of said air diffuser.

31. An air conditioner of claim 30, wherein said straightening plate has a shape such that said heat exchanged air is blown out from said both ends in a slightly horizontal direction than the lower direction.

32. An air conditioner of claim 1, wherein said air diffuser has a passage comprising a stabilizer and a rear guider, said stabilizer is disposed at a lower side of said passage, said stabilizer has a leading end bump formed at a leading end at an outlet of said air diffuser and at the center in the horizontal direction of said air diffuser, and said stabilizer has a straightening plate extending substantially in the horizontal direction, and disposed at the leading end of the outlet of said air diffuser.

33. An air conditioner of claim 32, wherein said leading end bump has a shape so that the heat exchanged air is blown out from said center in a further horizontal direction, and said straightening plate has a shape such that said heat exchanged air is blown out from said both ends in a slightly horizontal direction than in the lower direction.

34. An air conditioner of claim 32, having a substantially sector shape so as to be installed at a corner of two adjacent walls.

35. An air conditioner of claim 1, having a substantially sector shape so as to be installed at a corner of two adjacent walls.

36. An air conditioner of claim 32, wherein said air diffuser extends outward from said air conditioner in substantially an arc shape so as to be installed at a corner of two adjacent walls.

37. An air conditioner of claim 1, wherein said air diffuser extends outward from said air conditioner in substantially an arc shape so as to be installed at a corner of two adjacent walls.

38. An air conditioner of claim 1, wherein said air diffuser extends outward from said air conditioner in substantially an arc shape, and a back side of said air diffuser is mounted on a wall.

39. An air conditioner of claim 1, wherein a section in a horizontal direction has a shape selected from the group consisting of a square, rectangle, circle and ellipse, to allow installation at a corner of mutually adjacent walls in a room, and said air diffuser is disposed at a position in a direction toward an interior of said room.

40. An air conditioner of claim 39, wherein said air diffuser has a substantially arc shape or a substantially linear shape.

* * * * *